US011821359B2

(12) United States Patent
Okada et al.

(10) Patent No.: US 11,821,359 B2
(45) Date of Patent: Nov. 21, 2023

(54) V8 ENGINE

(71) Applicant: HONDA MOTOR CO., LTD., Tokyo (JP)

(72) Inventors: Takeshi Okada, Wako (JP); Tatsuya Kuroda, Wako (JP); Masami Okubo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/798,899

(22) PCT Filed: Feb. 26, 2020

(86) PCT No.: PCT/JP2020/007634
§ 371 (c)(1),
(2) Date: Aug. 11, 2022

(87) PCT Pub. No.: WO2021/171405
PCT Pub. Date: Sep. 2, 2021

(65) Prior Publication Data
US 2023/0109196 A1 Apr. 6, 2023

(51) Int. Cl.
*F02B 61/04* (2006.01)
*F02B 75/22* (2006.01)
*F02B 75/18* (2006.01)

(52) U.S. Cl.
CPC ..... *F02B 61/045* (2013.01); *F02B 75/22* (2013.01); *F02B 2075/1832* (2013.01)

(58) Field of Classification Search
CPC . F02B 61/045; F02B 75/22; F02B 2075/1832
See application file for complete search history.

(56) References Cited

U.S. PATENT DOCUMENTS 1,335,143 A * 3/1920 Vincent ..... F02B 75/22 92/72
2012/0210958 A1* 8/2012 Keating ..... F02B 75/22 74/596

FOREIGN PATENT DOCUMENTS

| | | | |
|---|---|---|---|
| JP | 1996226493 | * | 3/1996 |
| JP | 08-226493 | | 9/1996 |
| JP | 2000-314351 | | 11/2000 |
| JP | 2004-286218 | | 10/2004 |
| JP | 2006-161691 | | 6/2006 |
| JP | 2017-190693 | | 10/2017 |
| JP | 2017190693 | * | 10/2017 |

OTHER PUBLICATIONS

International Search Report and Written Opinion for International Application No. PCT/JP2020/007634 dated May 26, 2020, 11 pages.

* cited by examiner

*Primary Examiner* — Syed O Hasan
(74) *Attorney, Agent, or Firm* — AMIN, TUROCY & WATSON, LLP

(57) ABSTRACT

A V8 engine, each bank of which is configured such that four crank pins connected to four piston pins via a connecting rod are positioned at 90° intervals when viewed from one end of a crankshaft. The four crank pins on the bank side are offset by 60° relative to the four crank pins on the bank side when viewed from the one end.

7 Claims, 18 Drawing Sheets

FIG. 9

| FORM OF CRANKSHAFT | PATTERN | IGNITION ORDERING | | | | | | | |
|---|---|---|---|---|---|---|---|---|---|
| | | 1 | 2 | 3 | 4 | 5 | 6 | 7 | 8 |
| FIRST EXEMPLARY EMBODIMENT | A | #1 | #5 | #4 | #2 | #6 | #3 | #7 | #8 |
| | B | #1 | #3 | #7 | #2 | #6 | #5 | #4 | #8 |
| | C | #1 | #5 | #7 | #2 | #6 | #3 | #4 | #8 |
| | D | #1 | #5 | #4 | #8 | #6 | #3 | #7 | #2 |
| SECOND EXEMPLARY EMBODIMENT | A | #1 | #5 | #4 | #3 | #7 | #2 | #6 | #8 |
| | B | #1 | #2 | #6 | #3 | #7 | #5 | #4 | #8 |
| | C | #1 | #5 | #6 | #3 | #7 | #2 | #4 | #8 |
| | D | #1 | #5 | #4 | #8 | #7 | #2 | #6 | #3 |

V8 ENGINE

TECHNICAL FIELD

The present invention relates to a V8 engine having a bank angle of 60° between two banks.

BACKGROUND ART

In recent years, the output force of outboard motors, and the speed and stable traveling of ships equipped with outboard motors are increasing. Along therewith, ships equipped with multiple outboard motors have also appeared. As for such outboard motors as well, the size and scale of the engines installed in them is increasing and the number of cylinders of the engines is increasing. For example, concerning such large scale outboard motors, outboard motors that are equipped with a V6 engine or a V8 engine are in the mainstream. Among such engines, concerning a general type of V8 engine, engines have already been developed having a bank angle (included angle) between the two banks of 60° to 65°, 90°, 120°, or 180°. Moreover, in JP H08-226493 A, a design method for a V8 engine having a bank angle other than 90° is disclosed.

In this instance, in the case of designing an outboard motor equipped with a V8 engine, it is necessary to arrange each component such as the cooling system and the exhaust system within a limited space in the outboard motor while taking into account the size of the engine mounting space or the like. In particular, consistency in the specifications of the current outboard motors is important, and if the specifications differ for each of the models, problems arise in terms of manufacturing, cost, and maintenance. For example, in a V-type engine, it is possible for the air intake system and the exhaust system to be freely laid out on an inner side and an outer side of the banks. However, if the specifications differ for each of the models, the manufacturing process becomes complex and the number of component parts used in common becomes smaller, and therefore costs tend to rise. Further, if the maintenance method differs for each of such models, the level of complexity increases all the more.

Furthermore, in relation to the width and length of the outboard motors, in the case of a ship equipped with multiple outboard motors, for example, a ship equipped with five outboard motors arranged in parallel, outboard motors having a large width and length are undesirable in terms of product strategy. Moreover, a lengthwise direction of the outboard motors is a direction (a front/rear direction of the ship) from the engine head to the crankshaft, and a widthwise direction thereof is a direction (a left/right direction of the ship) perpendicular to the lengthwise direction.

In an outboard motor, the engine thereof occupies a large volume. In an outboard motor, in general, a rudder does not exist. Therefore, the effect of the rudder is obtained by swinging the outboard motor itself from side to side. In this case, there is no limitation imposed on all of the outboard motors being swung in the same direction and at the same angle. For example, when entering or leaving a port, the directions and angles of the outboard motors may be slightly changed. At that time, if the width and length of the outboard motors are large, the outboard motors interfere with each other, and therefore, there is a limitation on the number of outboard motors mounted on the ship.

In this manner, in order to design a high output V8 engine without major changes in the basic specification and size thereof for current models, for example, as is done conventionally, it is necessary for the intake system to be provided on the inner side of the banks, and for the exhaust system to be provided on the outer side of the banks. In this case, in a land vehicle, the bank angle from the combustion surface is generally 90° however, in an outboard motor, due to a balance between the width and the length, it is desirable for the bank angle to be narrower than 90°.

SUMMARY OF THE INVENTION

In the foregoing manner, in the case that specifications for a V8 engine are set, vibrations and the timing of explosions become issues in need of consideration. For example, in the case that the bank angle is set to 60°, an offset of the crank pins between the two banks is generally set to 30°, and in this case, the main inertial forces generated in the crankshaft are a primary inertial force, a secondary inertial force, a primary inertia couple, a secondary inertia couple, and the like. Among these forces, even with a conventional configuration, the primary inertial force, the secondary inertial force, and the secondary inertia couple are capable of being canceled out. In contrast thereto, in order for the primary inertia couple to be canceled out, it becomes necessary for a countermeasure to be adopted such as installing a coupling force balancer that rotates in an opposite direction to the rotation direction of the engine. However, in order for such a balancer to be installed, a space for installation of the balancer inside the engine, and additional component parts in order to install the balancer are separately required.

The present invention has been devised taking into consideration the aforementioned problem, and has the object of providing a V8 engine which is capable of canceling out a primary inertia couple without requiring the use of specialized component parts.

An aspect of the present invention relates to a V8 engine in which a bank angle between two banks is 60°. The V8 engine comprises a crankshaft, eight pistons disposed in respective cylinders of the banks, and eight connecting rods having small end portions engaged with piston pins provided on the respective pistons, and having large end portions engaged with crank pins provided on the crankshaft. In this case, for each of the banks, four of the crank pins, which are connected via the connecting rods to four of the piston pins, are disposed at an interval of 90° as viewed from one end portion of the crankshaft. Further, with respect to the four crank pins on a side of one of the banks, the four crank pins on a side of another of the banks are offset by 60°, when viewed from the one end portion.

According to the present invention, in each of the banks, the four crank pins are arranged at an interval of 90° when viewed from the one end portion of the crankshaft, and the four crank pins on the side of the other bank are offset by 60° with respect to the four crank pins on the side of the one bank. Consequently, without the addition of specialized component parts, it becomes possible for the primary inertia couple to be canceled out.

BRIEF DESCRIPTION OF THE DRAWINGS

FIG. 9 is an explanatory diagram showing an ignition ordering of the engine;

DESCRIPTION OF THE INVENTION

Hereinafter, a preferred embodiment of a V8 engine according to the present invention will be exemplified and described with reference to the accompanying drawings.

[1. Schematic Configuration of the Present Embodiment]

Figure 1A:
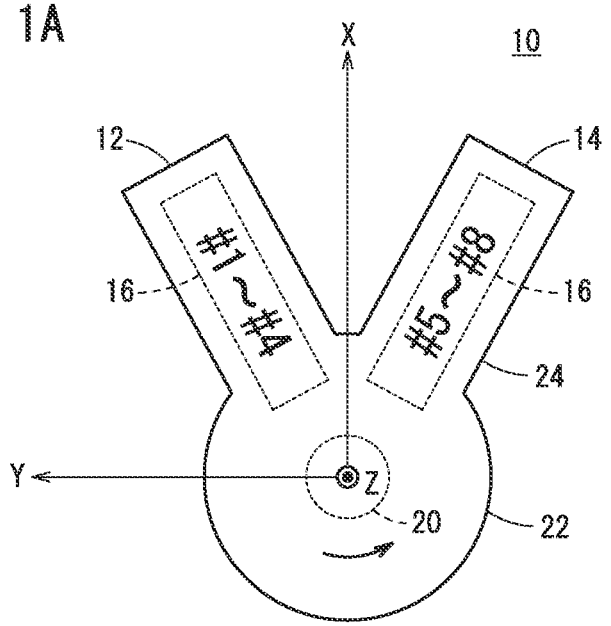
FIG. 1A is a schematic plan view of an engine according to the present embodiment.
Figure 1B:
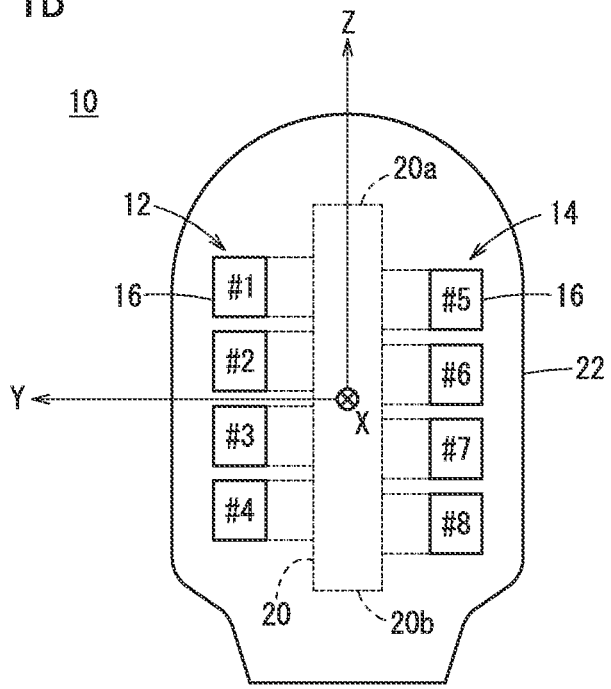
FIG. 1B is a schematic front view of the engine shown in FIG. 1A.
Figure 2:
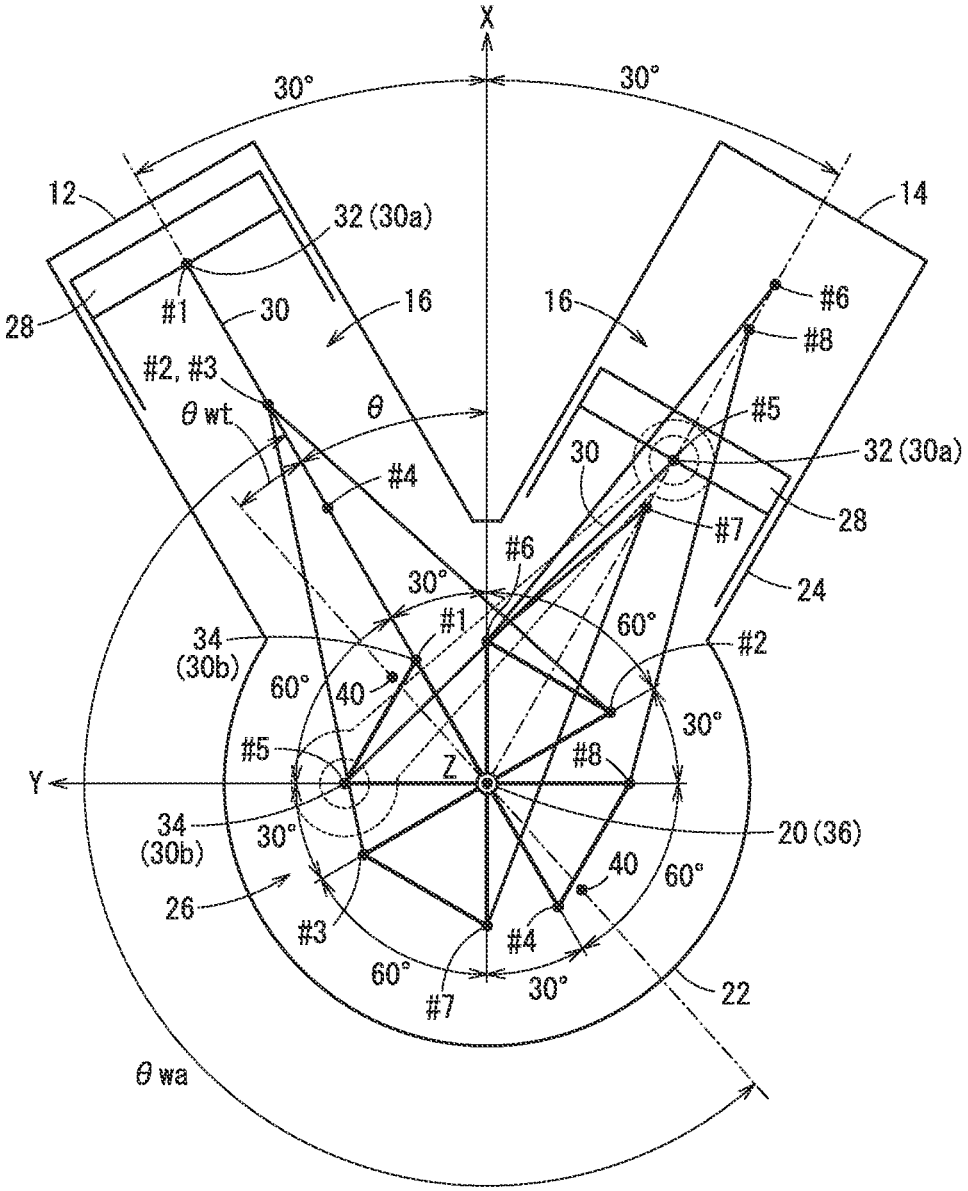
FIG. 2 is a schematic plan view according to a first exemplary embodiment of the engine according to the present embodiment.

As shown in FIGS. 1A to 2, a V8 engine 10 according to the present embodiment (hereinafter referred to as an engine 10 according to the present embodiment) is a V-type engine having a bank angle between two banks 12 and 14 of 60°, and four cylinders 16 are provided respectively in each of the banks 12 and 14. The engine 10 according to the present embodiment is applied, for example, to an engine for use with an outboard motor.

The engine 10 includes, for example, a crankshaft 20, a crankcase 22 in which the crankshaft 20 is accommodated, and a cylinder block 24 in which the two banks 12 and 14 extend from the crankcase 22 at a bank angle (included angle) of 60°.

Four cylinders 16 are provided respectively in each of the banks 12 and 14. In FIGS. 1A and 1B, a case is shown in which, along the Z direction in which the crankshaft 20 extends, four cylinders 16 designated by cylinder numbers "#1 to #4" are provided in one bank 12, and four cylinders 16 designated by cylinder numbers "#5 to #8" are provided in the other bank 14. The cylinders 16 of the other bank 14 are arranged along the Z direction so as to be offset between the four cylinders 16 of the one bank 12.

Moreover, in the present embodiment, a positive direction (Z direction) of the Z-axis is a direction toward one end portion 20*a* of the crankshaft 20. Therefore, a negative direction of the Z-axis is a direction toward another end portion 20*b* of the crankshaft 20. Further, on the sheet surface of FIGS. 1A and 1B, a positive direction (Y direction) of the Y-axis is a direction that is perpendicular to the Z-axis and extends in a leftward direction from the Z-axis. Further, a positive direction (X direction) of the X-axis is a direction that is perpendicular to the Y-axis and the Z-axis, and extends in an upward direction from the Y-axis and the Z-axis on the sheet surface of FIG. 1A.

Further still, on the sheet surface of FIG. 1A, the direction of rotation of the engine 10 may be any direction, as long as the direction involves rotating about an axis of the crankshaft 20. According to the present embodiment, as shown in FIG. 1A, a case is illustrated in which a counterclockwise direction of rotation is the direction of rotation of the engine 10, and the counterclockwise direction is regarded as a forward rotation. Therefore, for example, in the case that the engine 10 is applied to an outboard motor, the engine 10 is mounted on the outboard motor with the Z direction defined as an upward direction, the X direction defined as a rearward direction, and the Y direction defined as a leftward direction.

Figure 4:
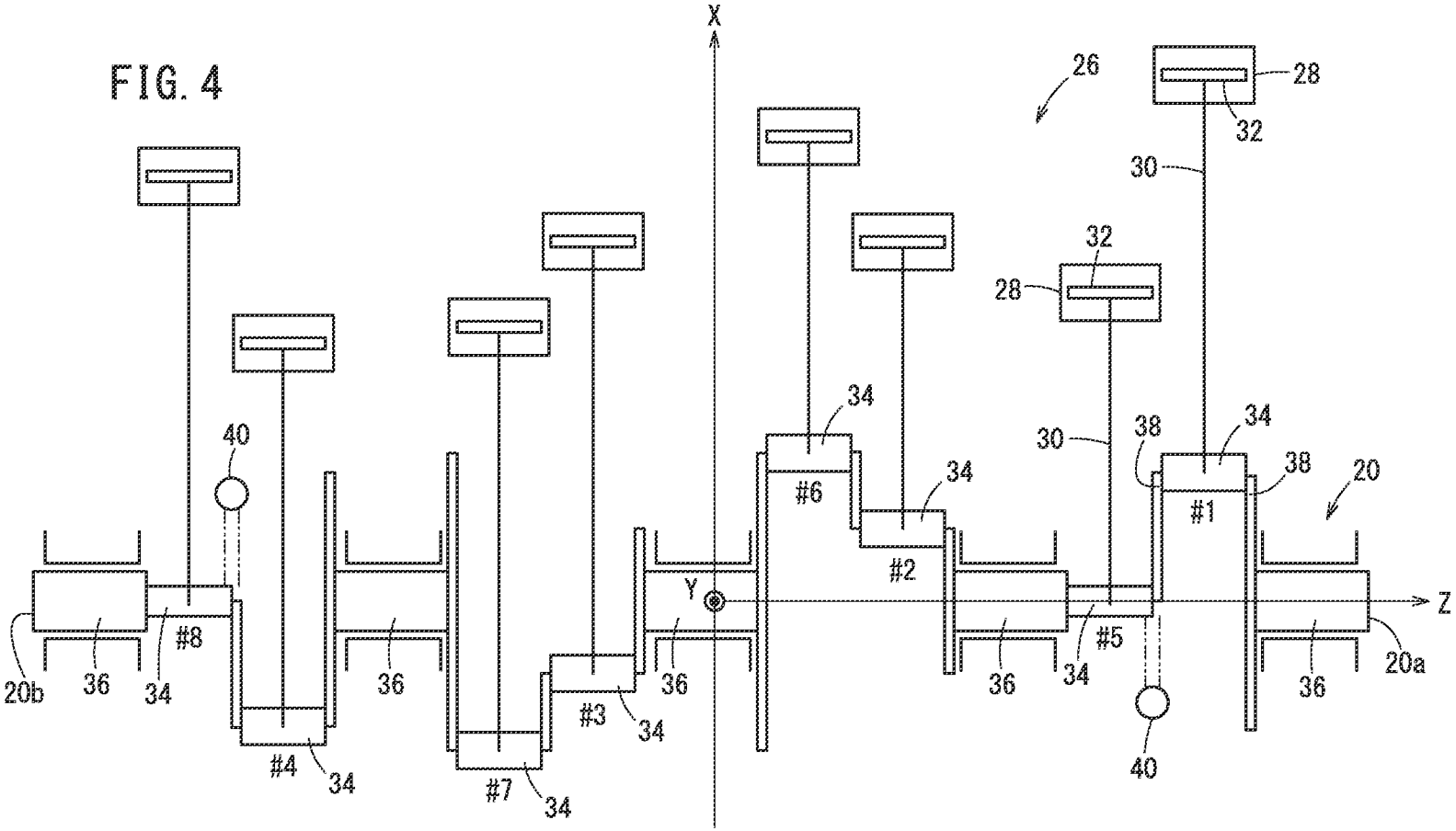
FIG. 4 is a schematic side view of the first exemplary embodiment shown in FIG. 2.
Figure 5:
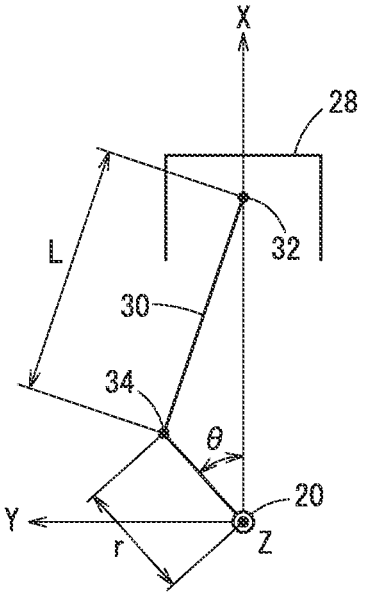
FIG. 5 is an explanatory diagram schematically illustrating a configuration of one cylinder of a main motor system.
Figure 6:
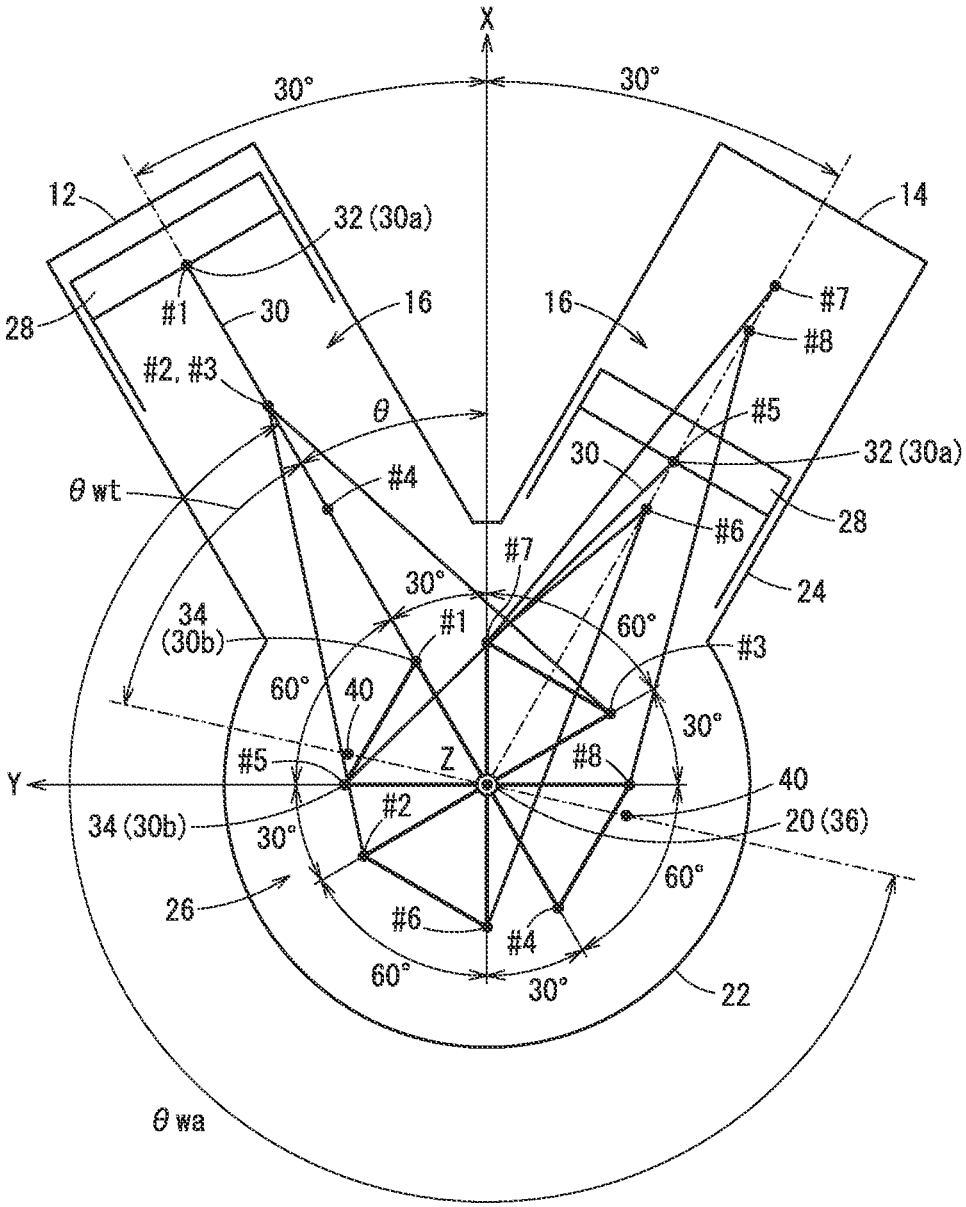
FIG. 6 is a schematic plan view according to a second exemplary embodiment of the engine according to the present embodiment.
Figure 7:
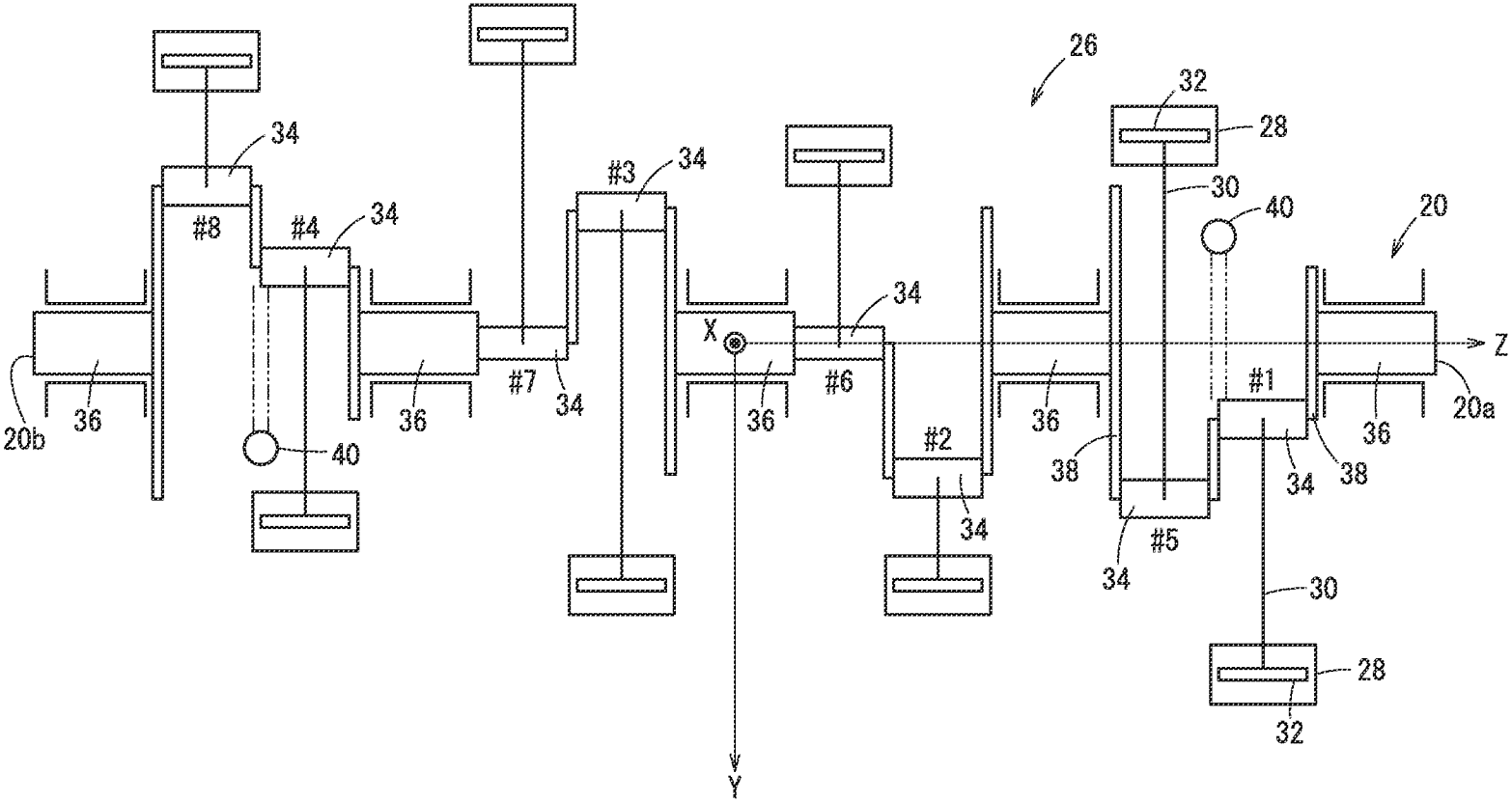
FIG. 7 is a schematic side view of the second exemplary embodiment shown in FIG. 6.
Figure 8:
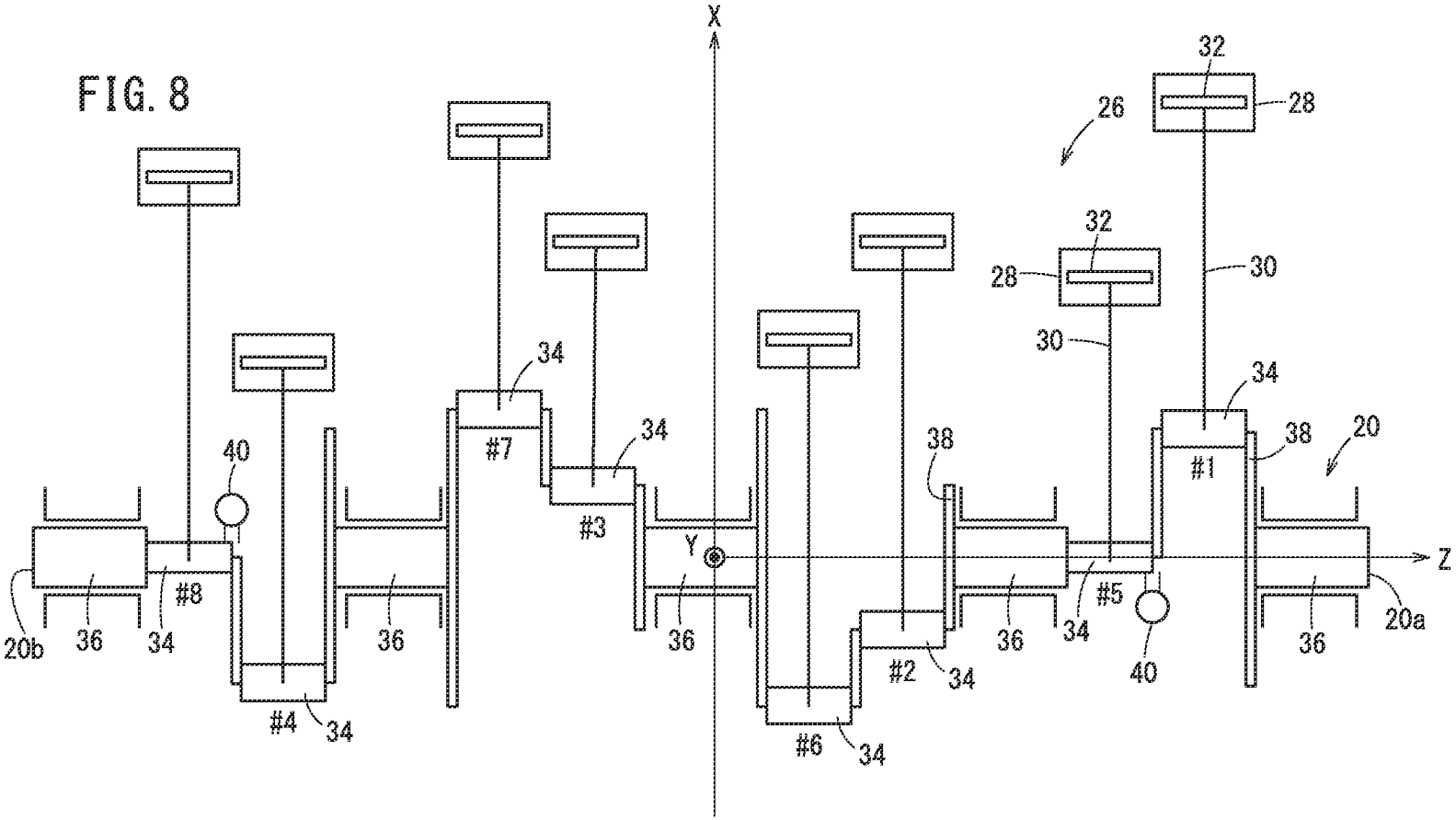
FIG. 8 is a schematic side view of the second exemplary embodiment shown in FIG. 6.

In addition, as configurations of a main motion system 26 of the engine 10 including the crankshaft 20, the engine 10 according to the present embodiment includes two configurations, namely, the configuration shown in FIGS. 2 to 5 (first exemplary embodiment), and the configuration shown in FIGS. 6 to 8 (second exemplary embodiment). In this instance, the configuration of the first exemplary embodiment will initially be described, and thereafter, different points of the configuration of the second exemplary embodiment from those of the first exemplary embodiment will be described.

[2. First Exemplary Embodiment]

In the first exemplary embodiment, the engine 10 includes the crankshaft 20, a total of eight pistons 28 arranged in the respective cylinders 16 of the two banks 12 and 14, and a total of eight connecting rods 30 that connect the eight pistons 28 and the crankshaft 20. On each of the connecting rods 30, a small end portion 30*a* thereof engages with a piston pin 32 provided on a corresponding one of the pistons 28, whereas a large end portion 30*b* thereof engages with a crank pin 34 provided on the crankshaft 20.

Moreover, in FIG. 2, the piston pins 32 and the crank pins 34 are assigned with corresponding cylinder numbers "#1 to #8", and the connections between the piston pins 32 and the crank pins 34 via the connecting rods 30 in the respective cylinders 16 are schematically illustrated. Further, in FIG. 2, concerning the cylinder numbers #1 and #5, the positions of the pistons 28 are also shown.

Furthermore, in FIG. 2, concerning cylinder number #5, the connected states of the piston 28, the piston pin 32, the connecting rod 30, and the crank pin 34 thereof are representatively shown by dashed lines. Actually, although the same connected states as those of cylinder number #5 are established in the other cylinder numbers, in the following description, for the sake of convenience, the connected states thereof are shown by solid lines and are illustrated in a simplified manner.

Furthermore, in FIG. 2, the angle of the crank pin 34 of cylinder number #1 with respect to the X-axis is shown as θ. Further, in FIGS. 3 and 4, each of the connecting rods 30 is schematically shown in the form of a straight line.

The crankshaft 20 is constituted by five main rotating shafts 36 passing through the Z-axis, eight crank pins 34 arranged between the respective main rotating shafts 36, and a plurality of crank webs 38 extending in the radial direction of the main rotating shafts 36 and connecting the crank pins 34 to the main rotating shafts 36.

Figure 3:
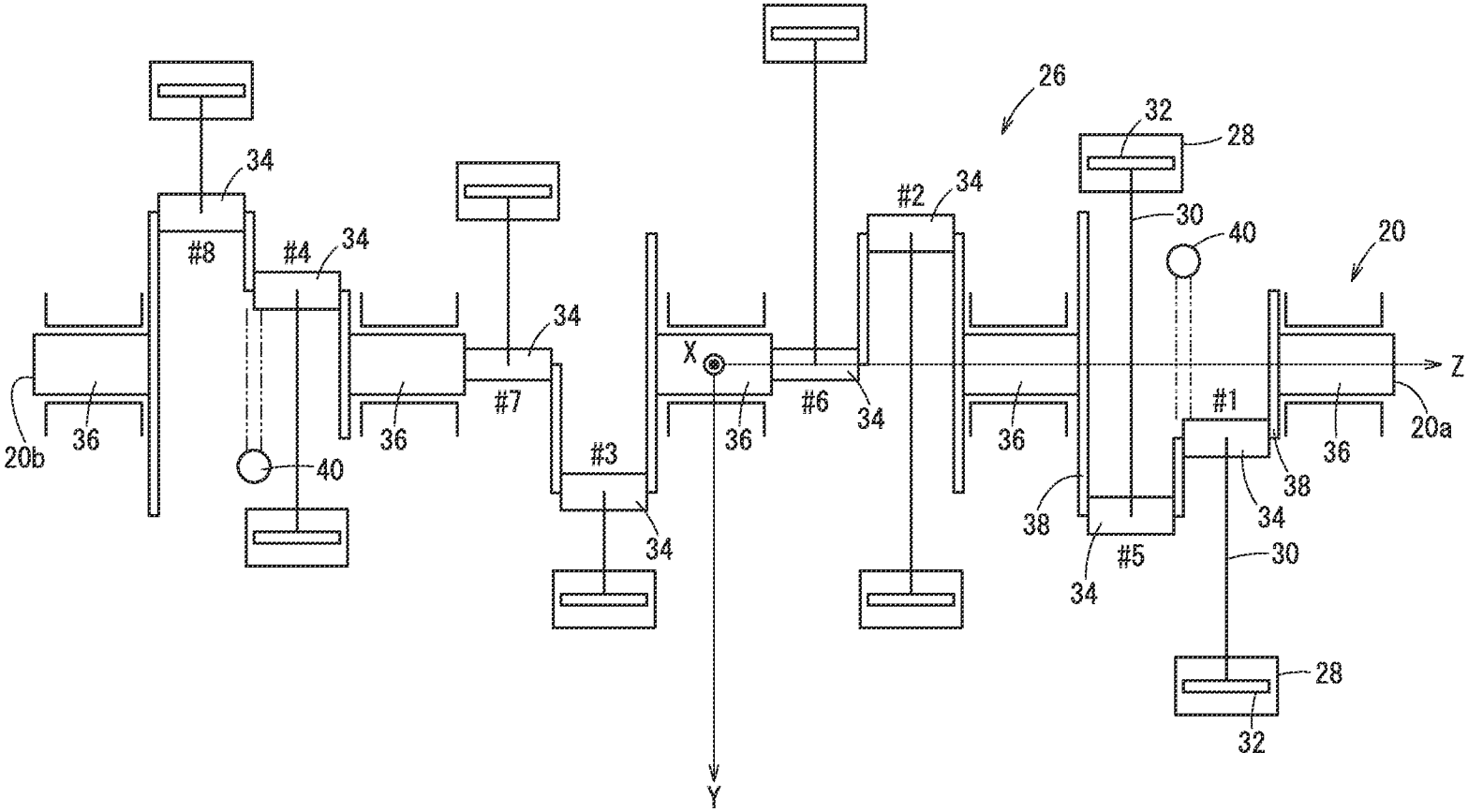
FIG. 3 is a schematic side view of the first exemplary embodiment shown in FIG. 2.

FIG. 3 is a configuration diagram of the main motion system 26 as viewed from the X direction (as viewed from above on the sheet surface of FIG. 1A). FIG. 4 is a configuration diagram of the main motion system 26 as viewed from the Y direction (as viewed from a leftward direction on the sheet surface of FIG. 1B). In this instance, the main motion system 26 includes the crankshaft 20, the respective pistons 28, the respective piston pins 32, and the respective connecting rods 30.

As shown in FIGS. 3 and 4, the crank pins 34 corresponding to the cylinders 16 of the respective banks 12 and 14 are alternately arranged on the crankshaft 20, from the one end portion 20*a* (on a positive direction side of the Z-axis) to the other end portion 20*b* (on a negative direction side of the Z-axis) of the crankshaft 20. More specifically, from the one end portion 20*a* toward the other end portion 20*b* of the crankshaft 20, the crank pins 34 corresponding to the respective cylinders 16 are arranged in order of cylinder numbers #1, #5, #2, #6, #3, #7, #4, and #8.

In other words, the four crank pins 34 on the one bank 12 side (the bank 12 on the left side in FIG. 2) are provided on the crankshaft 20 at a predetermined interval along the Z direction, from the one end portion 20*a* to the other end portion 20*b* of the crankshaft 20 in order of cylinder numbers #1, #2, #3, and #4. Further, the four crank pins 34 on the other bank 14 side (the bank 14 on the right side in FIG. 2) are provided on the crankshaft 20 at a predetermined interval along the Z direction, from the one end portion 20*a* to the other end portion 20*b* of the crankshaft 20, in order of cylinder numbers #5, #6, #7, and #8, so as to be arranged alternately with the four crank pins 34 on the one bank 12.

In addition, according to the first exemplary embodiment, in each of the banks 12 and 14, as shown in FIG. 2, the four crank pins 34, which are connected via the connecting rods 30 to the four piston pins 32, are arranged at an interval of 90° when viewed from the Z direction (as viewed from the one end portion 20*a* of the crankshaft 20). Further, as viewed from the Z direction, the four crank pins 34 on the other bank 14 side (the bank 14 on the right side of FIG. 2) are offset by 60° with respect to the four crank pins 34 on the one bank 12 side (the bank 12 on the left side of FIG. 2).

More specifically, concerning each of the banks 12 and 14, when viewed from the Z direction, among the four crank pins 34, the crank pin 34 (of cylinder number #1, #5) on the one end portion 20*a* side and the crank pin 34 (of cylinder number #4, #8) on the other end portion 20*b* side of the crankshaft 20 are arranged point-symmetrically with the main rotating shafts 36 of the crankshaft 20 being interposed therebetween. Further, when viewed from the Z direction, among the two crank pins 34 between the crank pin 34 on the one end portion 20*a* side and the crank pin 34 on the other end portion 20*b* side of the crankshaft 20, the crank pin 34 (of cylinder number #2, #6) in proximity to the one end portion 20*a* is arranged so as to be offset by 270° with respect to the crank pin 34 on the one end portion 20*a* side. Furthermore, the crank pin 34 (of cylinder number #3, #7) in proximity to the other end portion 20*b* is arranged so as to be offset by 90° with respect to the crank pin 34 on the one end portion 20*a* side. In addition, the four crank pins 34 on the other bank 14 side are offset by 60° with respect to the four crank pins 34 on the one bank 12 side.

To describe the same in greater detail, as shown in FIG. 2, the four crank pins 34 on the one bank 12 side are arranged at a 90° interval in the direction (the positive direction) of rotation of the engine 10, in order of cylinder numbers #1, #3, #4, and #2. On the other hand, in a state of being offset by 60° from the four crank pins 34 on the one bank 12 side, the four crank pins 34 on the other bank 14 side are arranged at a 90° interval in the direction (the positive direction) of rotation of the engine 10, in order of cylinder numbers #5, #7, #8, and #6. In particular, the cylinders 16 of cylinder numbers #1 and #5 are formed as a pair, and these two cylinders 16 are offset in an opened state with a phase difference of 60°. Further, concerning the other cylinders as well, the cylinders 16 of cylinder numbers #2 and #6, the cylinders 16 of cylinder numbers #3 and #7, and the cylinders 16 of cylinder numbers #4 and #8 are offset in an opened state with a phase difference of 60°.

[3. Primary Inertia Couple of the First Exemplary Embodiment]

According to the first exemplary embodiment, in order to cancel out the primary inertia couple, the main motion system 26 is configured in the manner described above. Accordingly, as shown in FIG. 5, concerning one cylinder of the main motion system 26, in the case that a rotating member mass mrot, which is a mass on the crank pin 34 side, is −½ of a reciprocating member mass mrec, which is a mass on the piston pin 32 side (mrot=(−½)×mrec), the addition of weights 40 to the crankshaft 20 is unnecessary.

In this instance, the reciprocating member mass mrec is a total value of the equivalent masses of the pistons 28, the piston pins 32, and the connecting rods 30 on the piston 28 side. Further, the rotating member mass mrot indicates a total value of the equivalent masses of the crank pins 34 and the crank webs 38 on the crank radius, and the equivalent masses of the connecting rods 30 on the crank pin 34 side. Moreover, because the reciprocating member mass mrec and the rotating member mass mrot are already well known (refer to "JSME Mechanical Engineers' Handbook", The Japan Society of Mechanical Engineers, Maruzen. Pub. Co., Ltd., Sep. 25, 2001, pp. A3 to 142 (Chapter 13, Dynamics of Reciprocating Machines), detailed description thereof is omitted.

Further, in the case that the rotating member mass mrot is −½ of the reciprocating member mass mrec (mrot=(−½)×mrec), this implies that half of the reciprocating member mass mrec is in a point symmetrical position to the crank pins 34 about the main rotating shafts 36. This corresponds to a so-called crankshaft overbalance ratio of 50%.

On the other hand, in the case that the rotating member mass mrot is not −½ of the reciprocating member mass mrec (mrot≠(−½)×mrec), the weights 40, which balance the primary inertia couple generated in the crankshaft 20 at a time when the engine 10 is rotating, are added at two locations on the one end portion 20*a* side and on the other end portion 20*b* side of the crankshaft 20. In FIGS. 2 to 4, an example of the arrangement of the weights 40 is illustrated.

In this case, the weight 40 on the other end portion 20*b* side is added at an angular position of θwt with respect to the crank pin 34 of cylinder number #1. For example, as shown in FIG. 2, the weight 40 may be added to the crankshaft 20 in a manner so that moments Mx and My generated by the equations (36) and (37), to be described later, are capable of being canceled out. More specifically, the weight 40 may be placed at an angular position of 11.57° from the phase of the crank pin 34 of cylinder number #1.

Further, the weight 40 on the one end portion 20*a* side is added to a position that is point symmetrical (on an opposite side) to the weight 40 on the other end portion 20*b* side, with the main rotating shafts 36 being interposed therebetween when viewed from the Z direction. For example, in FIG. 2, the weight 40 may be placed at an angular position of 191.57° from the phase of the crank pin 34 of cylinder number #1.

Furthermore, on the crankshaft 20, the weights 40 can be added in a distributed manner to the respective cylinders 16.

Moreover, the reason as to why the primary inertia couple is capable of being canceled out, without adding the weights 40, or by adding the weights 40, will be described later.

[4. Primary Inertia Couple of the Second Exemplary Embodiment]

In the second exemplary embodiment, as shown in FIGS. 6 to 8, for example, the arrangement of the crank pins 34 between the one end portion 20*a* and the other end portion 20*b* of the crankshaft 20 differs from that of the first exemplary embodiment.

The configuration of the second exemplary embodiment differs from the configuration of the first exemplary embodiment in that, as shown in FIG. 6, concerning each of the banks 12 and 14, when viewed from the Z direction, among the two crank pins 34 between the crank pin 34 on the one end portion 20*a* side (of cylinder numbers #1, #5) and the crank pin 34 on the other end portion 20*b* side (of cylinder number #4, #8) of the crankshaft 20, the crank pin 34 (of cylinder number #3, #7) in proximity to the other end portion 20*b* is arranged so as to be offset by 270° with respect to the crank pin 34 on the one end portion 20*a* side, and the crank pin 34 (of cylinder number #2, #6) in proximity to the one end portion 20*a* is arranged so as to be offset by 90° with respect to the crank pin 34 on the one end portion 20*a* side.

To describe the same in greater detail, as shown in FIG. 6, the four crank pins 34 on the one bank 12 side are arranged at a 90° interval in the direction (the positive direction) of rotation of the engine 10, in order of cylinder numbers #1, #2, #4, and #3. Further, in a state of being offset by 60° from the four crank pins 34 on the one bank 12 side, the four crank pins 34 on the other bank 14 side are arranged at a 90° interval in the direction (the positive direction) of rotation of the engine 10, in order of cylinder numbers #5, #6, #8, and #7. In other words, according to the second exemplary embodiment as well, the cylinders 16 of cylinder numbers #1 and #5 are formed as a pair, and these two cylinders 16 are offset in an opened state with a phase difference of 60°. Further, concerning the other cylinders as well, the cylinders 16 of cylinder numbers #2 and #6, the cylinders 16 of cylinder numbers #3 and #7, and the cylinders 16 of cylinder numbers #4 and #8 are offset in an opened state with a phase difference of 60°.

In accordance with such features, as shown in FIGS. 7 and 8, in the configuration of the second exemplary embodiment, the positions of the crank pins 34 corresponding to the cylinder numbers #2, #3, #6, and #7 differ from the positions of the crank pins 34 in the configuration of the first exemplary embodiment shown in FIGS. 3 and 4. Accordingly, it should be kept in mind that, in the second exemplary embodiment, as shown in FIGS. 6 to 8, the positions of the pistons 28 in the cylinders 16 of cylinder numbers #2, #3, #6, and #7 also differ from those in the configuration of the first exemplary embodiment (refer to FIGS. 2 to 4).

Moreover, in the same manner as in the first exemplary embodiment, the primary inertia couple is capable of being canceled out, without adding the weights 40, or by adding the weights 40 in the second exemplary embodiment as well. Since the method of adding the weights 40 is the same as that of the first exemplary embodiment, detailed description thereof is omitted. However, by providing the weights 40 respectively on the one end portion 20*a* side and on the other end portion 20*b* side, the primary inertia couple is capable of being canceled out. In this case, as for the weight 40 on the other end portion 20*b* side, the weight 40 may be placed at an angular position of 48.43° from the phase of the crank pin 34 of cylinder number #1. Further, as for the weight 40 on the one end portion 20*a* side, the weight 40 may be placed at an angular position of 228.43° from the phase of the crank pin 34 of cylinder number #1.

[5. Interval of Explosions]

FIG. 9 is an explanatory diagram showing an ignition ordering of the cylinders 16 in the engine 10. In the description of the ignition ordering (interval of explosions), it should be kept in mind that, in FIGS. 2 and 6, as for the rotation of the engine 10, the clockwise direction is regarded as being a forward rotation. In each of the first exemplary embodiment and the second exemplary embodiment, four patterns (A to D) exist in the ignition ordering. Since the first exemplary embodiment is configured as shown in FIGS. 2 to 4, and the second exemplary embodiment is configured as shown in FIGS. 6 to 8, an ignition timing of the respective cylinders 16 results in explosions at non-regular intervals in a combination of a 60° interval, a 90° interval, and a 120° interval.

For example, a pattern A ignition timing according to the first exemplary embodiment is defined as follows. Between the first cylinder 16 of cylinder number #1 and the second cylinder 16 of cylinder number #5, as shown in FIG. 2, since the distance between the two crank pins 34 is 60°, and further, it is +60° from the one bank 12 to the other bank 14, the interval of explosions becomes 120° (60°+60°=120°). Between the second cylinder 16 of cylinder number #5 and the third cylinder 16 of cylinder number #4, since the distance between the two crank pins 34 is 120°, and further, it is −60° from the other bank 14 to the one bank 12, the interval of explosions becomes 60° (120°-60°=60°). Hereinafter, in a similar manner, the interval of explosions between the third cylinder 16 of cylinder number #4 and the fourth cylinder 16 of cylinder number #2 becomes 90°. The interval of explosions between the fourth cylinder 16 of cylinder number #2 and the fifth cylinder 16 of cylinder number #6 becomes 120°. The interval of explosions between the fifth cylinder 16 of cylinder number #6 and the sixth cylinder 16 of cylinder number #3 becomes 60°. The interval of explosions between the sixth cylinder 16 of cylinder number #3 and the seventh cylinder 16 of cylinder number #7 becomes 120°. The interval of explosions between the seventh cylinder 16 of cylinder number #7 and the eighth cylinder 16 of cylinder number #8 becomes 90°. The interval of explosions between the eighth cylinder 16 of cylinder number #8 and the first cylinder 16 of cylinder number #1 becomes 60°.

However, when attention is focused on the respective banks 12 and 14, the ignition timing of the four cylinders 16 involves explosions at non-regular intervals in a combination of a 90° interval, a 180° interval, and a 270° interval. For example, in the pattern A of the first exemplary embodiment, the interval of explosions between the first cylinder 16 of cylinder number #1 and the third cylinder 16 of cylinder number #4 becomes 180° (120°+60°=180°). The interval of explosions between the third cylinder 16 of cylinder number #4 and the fourth cylinder 16 of cylinder number #2 becomes 90°. The interval of explosions between the fourth cylinder 16 of cylinder number #2 and the sixth cylinder 16 of cylinder number #3 becomes 180° (120°+60°=180°). The interval of explosions between the sixth cylinder 16 of cylinder number #3 and the first cylinder 16 of cylinder number #1 becomes 270° (120°+90°+60°=270°).

In other words, the interval of explosions in the respective banks 12 and 14 becomes the same as the interval of explosions of a conventional 60° bank angle V-type engine in which the offset of the crank pins 34 is 30°, or a conventional 90° bank angle V8 engine such as a crossplane crankshaft. As a result, it may be considered that the engine 10 according to the present embodiment has the same output performance as that of a conventional V8 engine.

[6. Forces Generated in the Main Motion System 26 due to Rotation of the Engine 10]

Next, in the engine 10 according to the present embodiment, a description will be given with reference to FIGS. 10 to 18 concerning the various forces generated in the main motion system 26 due to rotation of the engine 10, and the fact that, by the respective configurations in the first exemplary embodiment and the second exemplary embodiment, these forces are capable of being canceled out. In this instance, such a description will be made while also referring as necessary to FIGS. 1A to 9.

Figure 10:
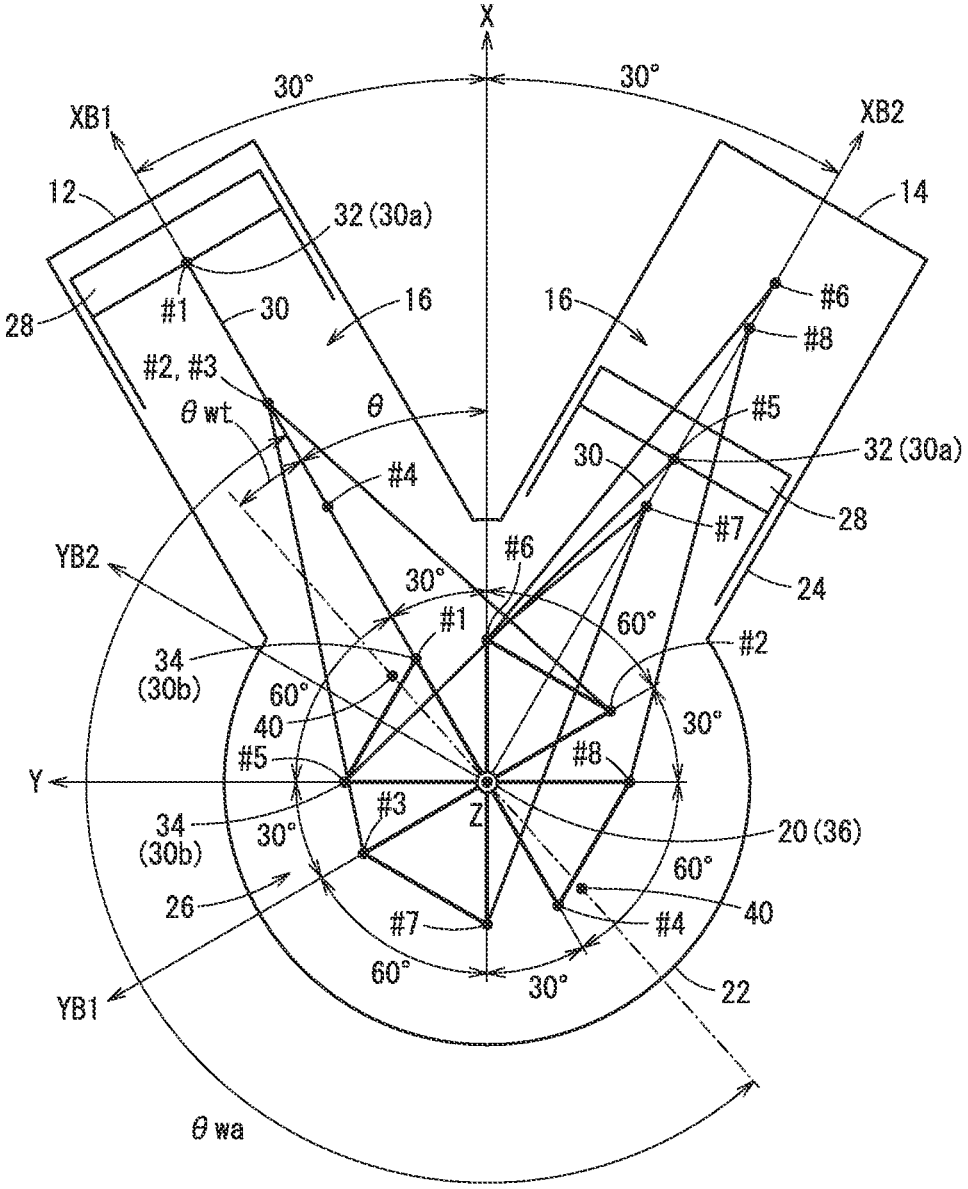
FIG. 10 is a schematic plan view illustrating a coordinate system of the first exemplary embodiment.
Figure 11:
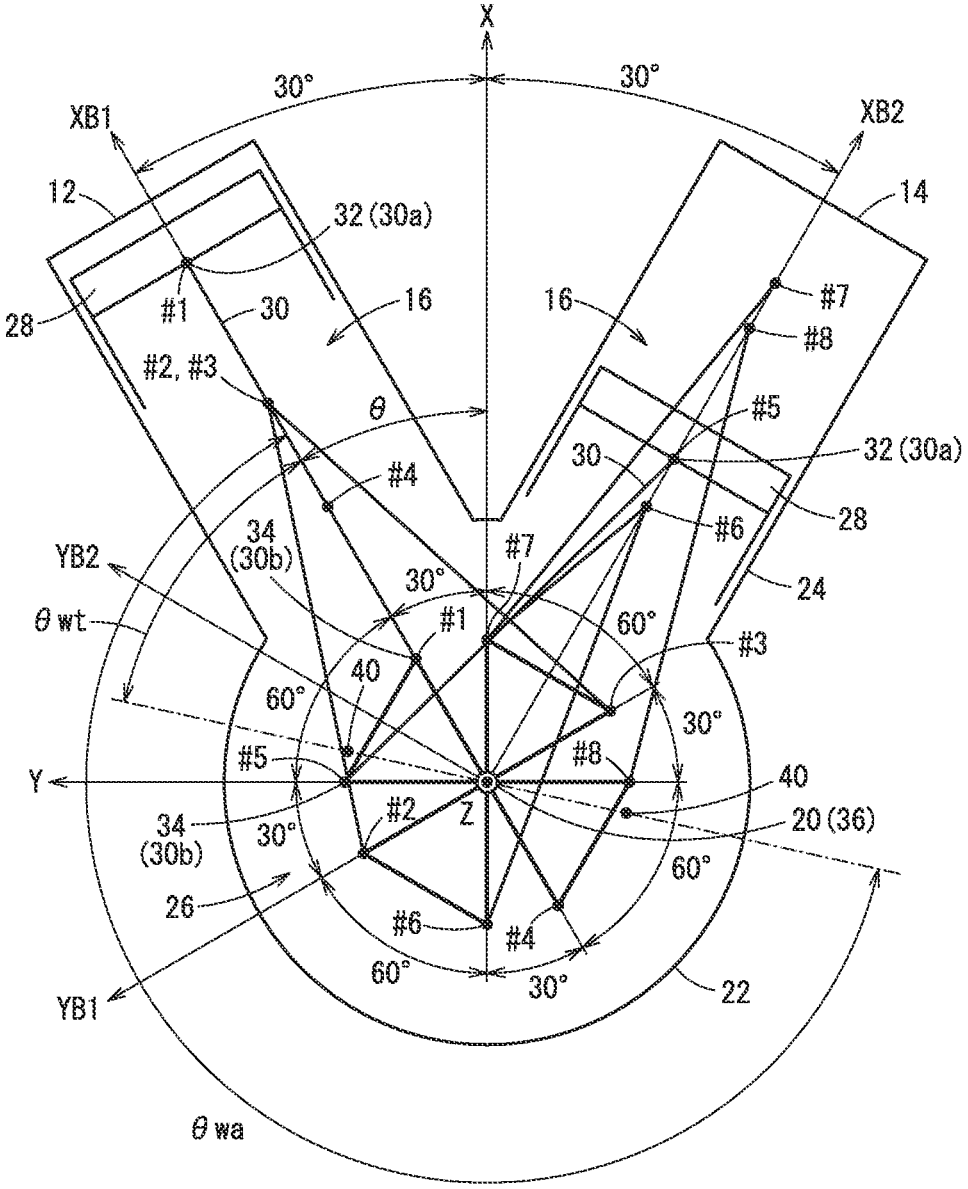
FIG. 11 is a schematic plan view illustrating a coordinate system of the second exemplary embodiment.
Figure 12:
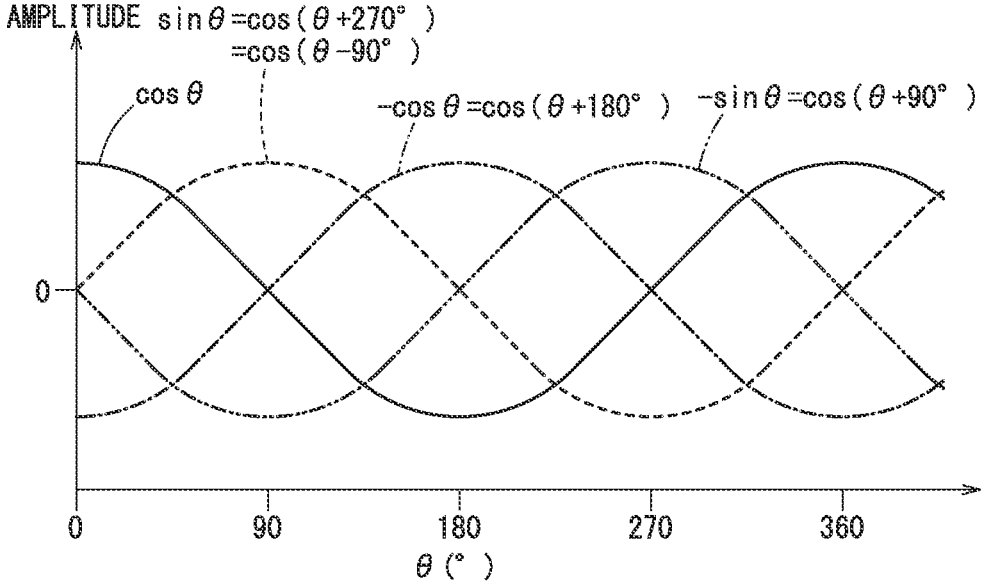
FIG. 12 is a diagram showing a relationship between cos θ, −cos θ, sin θ and −sin θ.

FIG. 10 illustrates the coordinate system in the configuration of the first exemplary embodiment. FIG. 11 illustrates the coordinate system in the configuration of the second exemplary embodiment. In FIGS. 10 and 11, a direction extending from the crankshaft 20 along each of the cylinders 16 on the one bank 12 side is defined as an XB1 direction, and a direction perpendicular to the XB1 direction is defined as a YB1 direction. Further, a direction extending from the crankshaft 20 along each of the cylinders 16 on the other bank 14 side is defined as an XB2 direction, and a direction perpendicular to the XB2 direction is defined as a YB2 direction. More specifically, the coordinate system of the X-axis, the Y-axis, and the Z-axis is the standard coordinate system, the coordinate system of the XB1-axis, the YB1-axis, and the Z-axis is a coordinate system based on the one bank 12, and the coordinate system of the XB2-axis, the YB2-axis, and the Z-axis is a coordinate system based on the other bank 14.

<6.1 Single Cylinder Engine>

First, when the explanatory diagram of FIG. 5 is regarded as being a schematic configuration of a single cylinder engine, the main inertial forces that act on the crankshaft 20 due to rotation of the engine will be described. In this instance, based on the content described in the aforementioned "JSME Mechanical Engineers' Handbook" (Chapter 13, Dynamics of Reciprocating Machines, pp. A3 to 142), an X directional component Fx and a Y directional component Fy of the inertial force are expressed by the following equation (1) and equation (2).

$$Fx=r\times\omega^2\times(\text{mrec}+\text{mrot})\times\cos\theta+(r^2/L)\times\omega^2\times\text{mrec}\times\cos 2\theta \quad (1)$$

$$Fy=r\times\omega^2\times\text{mrot}\times\sin\theta \quad (2)$$

In this instance, r is the radius of the crankshaft 20. ω is the angular velocity (ω=2πf, f: rotational frequency of the engine (the crankshaft 20)). L is a length of the connecting rod 30.

Moreover, the first item "$r\times\omega^2\times(\text{mrec}+\text{mrot})\times\cos\theta$" in equation (1) indicates the primary inertial force. Further, the second item "$(r^2/L)\times\omega^2\times\text{mrec}\times\cos 2\theta$" in equation (1) indicates the secondary inertial force. Furthermore, "$r\times\omega^2\times\text{mrot}\times\sin\theta$" in equation (2) indicates only the primary inertial force. More specifically, in the configuration of FIG. 5, a Y directional component of the secondary inertial force is not generated.

<6.2 Primary Inertial Force>

In contrast thereto, the engine 10 according to the present embodiment is a V8 engine. In this instance, a description will be given representatively concerning the forces generated in the configuration of the first exemplary embodiment when the engine 10 is rotated.

First, in the configuration of the first exemplary embodiment, an XB1 directional component Fxb1 of the primary inertial force that acts on the one bank 12 side in a coordinate system (the XB1-YB1-Z coordinate system) based on the one bank 12 is expressed by the following equation (3), which is based on the above-described equation (1).

$$\begin{aligned}Fxb1 &= Fx11+Fx21+Fx31+Fx41 = \\ &(mrec+mrot)\times r\times\omega^2\times\cos\theta+(mrec+mrot)\times r\times\omega^2\times\cos(\theta+270°)+ \\ &(mrec+mrot)\times r\times\omega^2\times\cos(\theta+90°)+ \\ &(mrec+mrot)\times r\times\omega^2\times\cos(\theta+180°)=(mrec+mrot)\times r\times\omega^2\times \\ &\{\cos\theta+\cos(\theta+270°)+\cos(\theta+90°)+\cos(\theta+180°)\}=(mrec+mrot)\times \\ &r\times\omega^2\times(\cos\theta+\sin\theta-\sin\theta-\cos\theta)=(mrec+mrot)\times r\times\omega^2\times 0=0\end{aligned} \quad (3)$$

Moreover, Fx11 to Fx41 are XB1 directional components of the primary inertial force generated in the cylinders 16 of cylinder numbers #1 to #4. Further, in FIG. 12, changes in cos θ, −cos θ, sin θ and −sin θ with respect to θ are illustrated.

Further, also concerning a YB1 directional component Fyb1 of the primary inertial force that acts on the one bank 12 side in a coordinate system based on the one bank 12, if calculated in the same manner as the above-described equation (3), based on the above-described equation (2), the YB1 directional component Fyb1 is expressed by the following equation (4).

$$Fyb1=0 \quad (4)$$

Figure 13A:
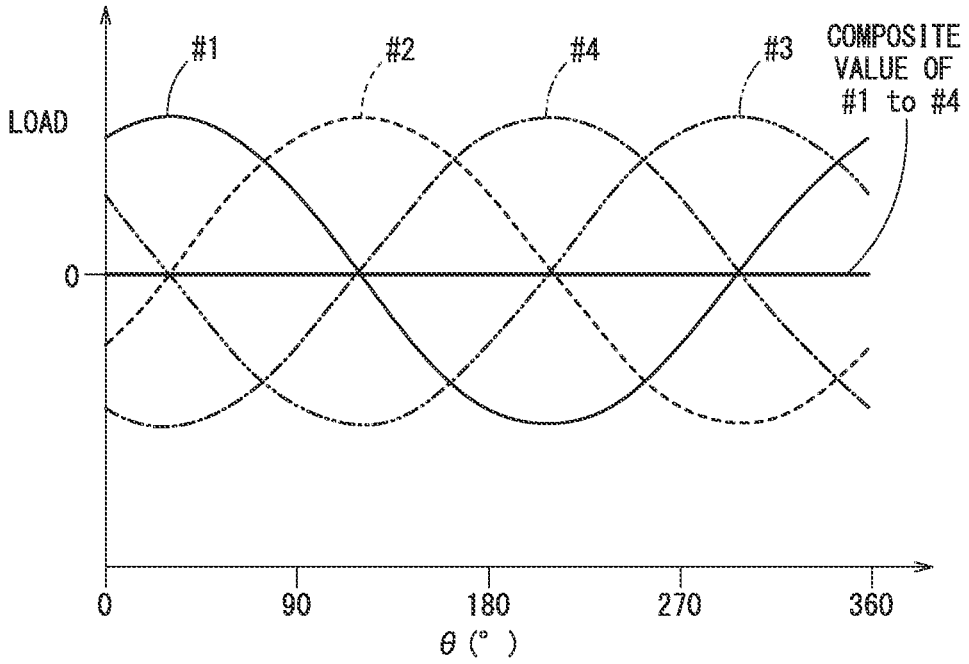
FIG. 13A is an explanatory diagram of an XB1 directional component of a primary inertial force that acts on a one bank side, when expressed in coordinates based on the one bank.
Figure 13B:
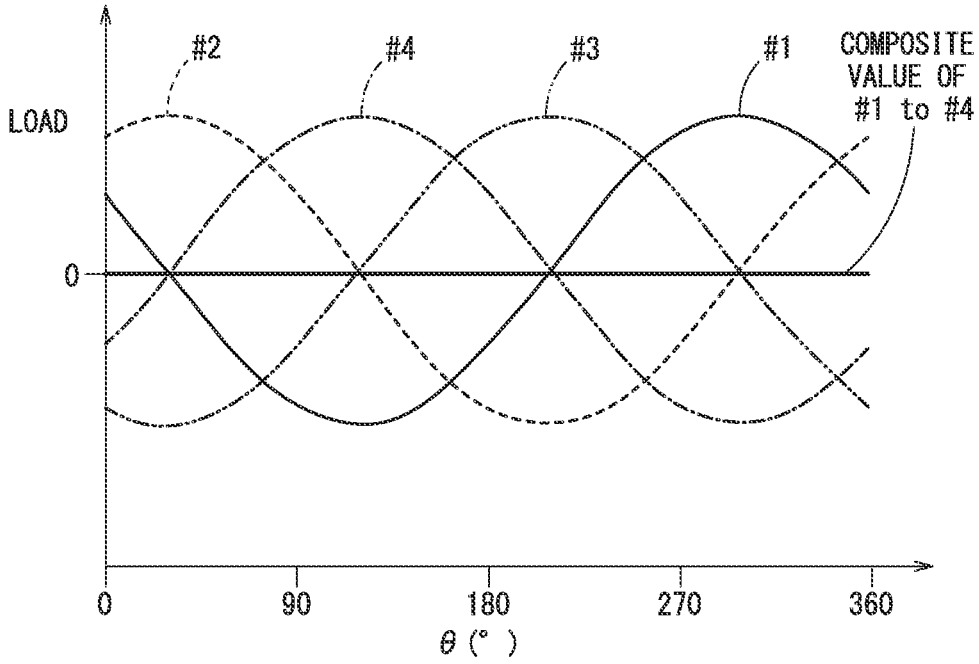
FIG. 13B is an explanatory diagram of a YB1 directional component of the primary inertial force that acts on the one bank side, when expressed in coordinates based on the one bank.

In this instance, changes in the primary inertial force corresponding to equation (3) and equation (4) are shown in FIG. 13A (result of the XB1 directional component) and FIG. 13B (result of the YB1 directional component).

The other bank 14 has a configuration in which the crank pins 34 are offset by 60° with respect to the one bank 12. Therefore, the primary inertial force becomes 0 on the other bank 14 side as well, in the same manner as on the one bank 12 side. In other words, within the respective banks 12 and 14, the primary inertial forces thereof are balanced. Accordingly, in the configuration of the first exemplary embodiment, the primary inertial force is not generated in the crankshaft 20.

<6.3 Secondary Inertial Force>

Next, the secondary inertial force in the configuration of the first exemplary embodiment will be examined. In the case of a single cylinder engine, as is clear from equation (2), the Y directional component of the secondary inertial force is not generated. Therefore, in this instance, concerning the one bank 12 side, only the XB1 directional component Fxb2 of the secondary inertial force in the coordinate system of the one bank 12 will be examined. Based on the above-described equation (1), Fxb2 is expressed by the following equation (5).

$$Fxb2 = Fx12 + Fx22 + Fx32 + Fx42 = \tag{5}$$
$$(r/L)\times mrec\times r\times\omega^2\times\cos 2\theta + (r/L)\times mrec\times r\times\omega^2\times\cos(2\theta+540°) +$$
$$(r/L)\times mrec\times r\times\omega^2\times\cos(2\theta+180°) +$$
$$(r/L)\times mrec\times r\times\omega^2\times\cos(2\theta+360°) =$$
$$(r/L)\times mrec\times r\times\omega^2\times(\cos 2\theta - \cos 2\theta - \cos 2\theta + \cos 2\theta) = 0$$

Figure 14A:
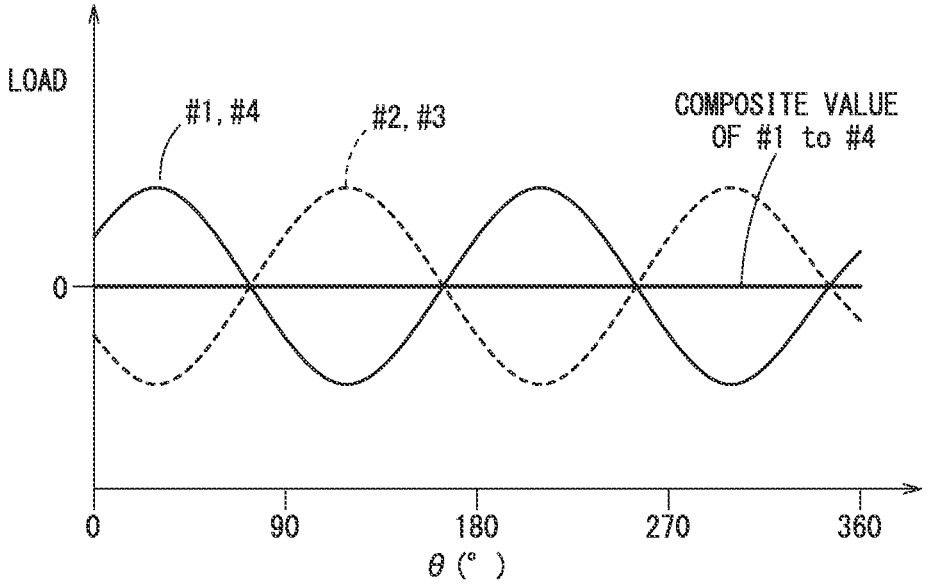
FIG. 14A is an explanatory diagram of an XB1 directional component of a secondary inertial force that acts on the one bank side, when expressed in coordinates based on the one bank.
Figure 14B:
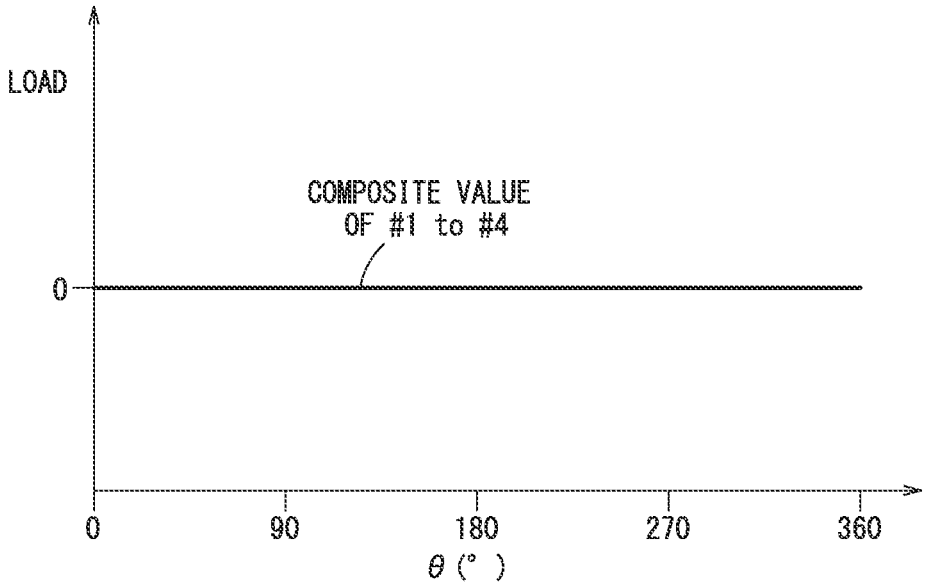
FIG. 14B is an explanatory diagram of a YB1 directional component of the secondary inertial force that acts on the one bank side, when expressed in coordinates based on the one bank.

In this instance, Fx12 to Fx42 are XB1 directional components of the secondary inertial forces generated in the cylinders 16 of cylinder numbers #1 to #4. Changes in the secondary inertial force corresponding to equation (5) and the like are shown in FIG. 14A (result of the XB1 directional component) and FIG. 14B (result of the YB1 directional component).

In the foregoing manner, since the other bank 14 has a configuration in which the crank pins 34 are offset by 60° with respect to the one bank 12, the secondary inertial force becomes 0 on the other bank 14 side as well, in the same manner as on the one bank 12 side. In other words, within the respective banks 12 and 14, the secondary inertial forces thereof are balanced. Accordingly, in the configuration of the first exemplary embodiment, the secondary inertial force is not generated in the crankshaft 20.

<6.4 Secondary Inertia Couple>

Next, the secondary inertia couple in the configuration of the first exemplary embodiment will be examined. As described previously, in the coordinate system of the one bank 12, the YB1 directional component of the secondary inertial force is not generated, and therefore, a secondary inertia couple Myb12, which is a moment around the YB1-axis generated by the XB1 directional component of the secondary inertial force, will be examined. Based on the above-described equation (1) and equation (5), Myb12 is expressed by the following equation (6).

$$Myb12 = Fx12\times L1 + Fx22\times L2 + Fx32\times L3 + Fx42\times L4 = \tag{6}$$
$$(r/L)\times mrec\times r\times\omega^2\times\cos 2\theta\times L1 + (r/L)\times mrec\times r\times\omega^2\times$$
$$\cos(2\theta+540°)\times L2 + (r/L)\times mrec\times r\times\omega^2\times\cos(2\theta+180°)\times L3 +$$
$$(r/L)\times mrec\times r\times\omega^2\times\cos(2\theta+360°)\times L4 = (r/L)\times mrec\times r\times$$
$$\omega^2\times(\cos 2\theta\times L1 - \cos 2\theta\times L2 - \cos 2\theta\times L3 + \cos 2\theta\times L4) =$$
$$(r/L)\times mrec\times r\times\omega^2\times(\cos 2\theta\times s - \cos 2\theta\times s) = 0$$

In this instance, L1 to L4 are Z coordinate values of points where the connecting rods 30 corresponding to the cylinders 16 of cylinder numbers #1 to #4 are projected onto the Z-axis. The term s is a bore pitch. In equation (6), a relationship between L1 to L4 and the bore pitch s is as shown in the following equation (7) and equation (8).

$$L1-L2=s \tag{7}$$

$$-L3+L4=-s \tag{8}$$

Figure 15A:
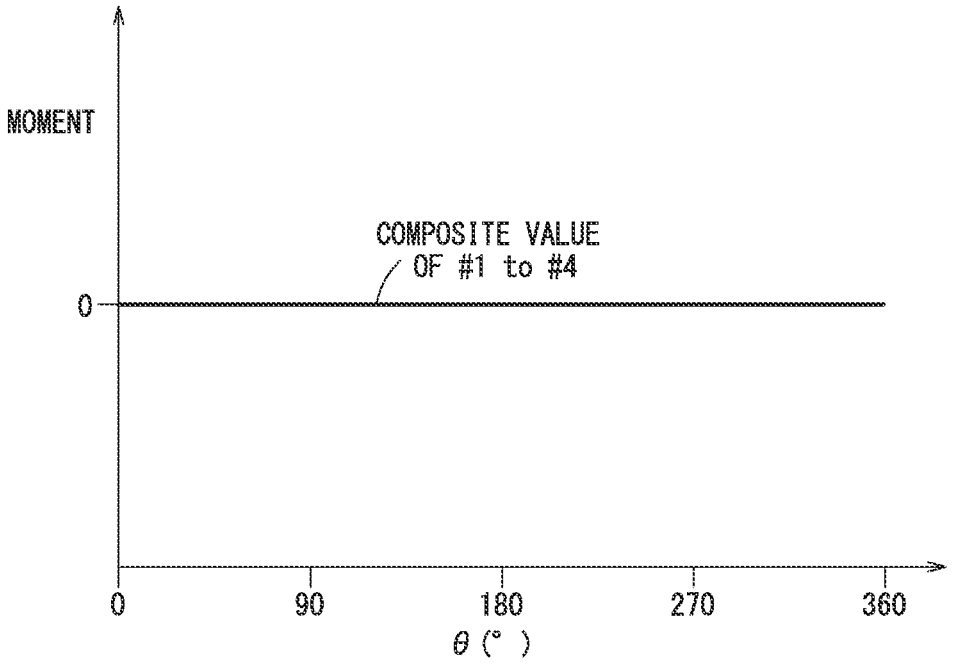
FIG. 15A is an explanatory diagram of a component of a secondary inertia couple around an XB1 axis that acts on the one bank side, when expressed in coordinates based on the one bank.
Figure 15B:
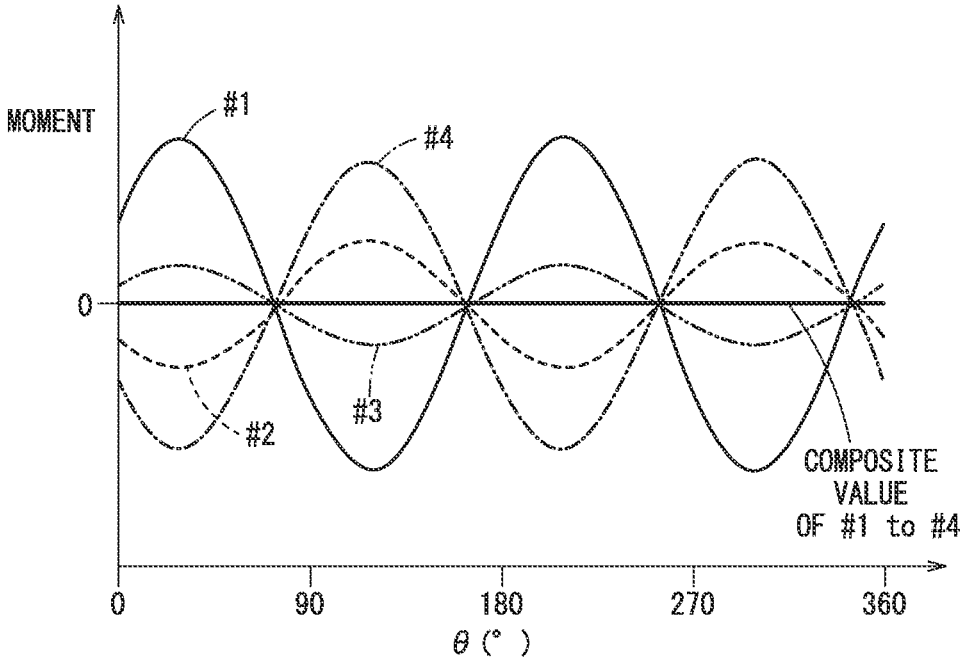
FIG. 15B is an explanatory diagram of a component of the secondary inertia couple around a YB1 axis that acts on the one bank side, when expressed in coordinates based on the one bank.

Changes in the secondary inertia couple corresponding to equation (6) and the like are shown in FIG. 15A (result of the component around the XB1 axis) and FIG. 15B (result of the component around the YB1 axis).

Moreover, since the other bank 14 has a configuration in which the crank pins 34 are offset by 60° with respect to the one bank 12, the secondary inertia couple becomes 0 on the other bank 14 side as well, in the same manner as on the one bank 12 side. In other words, within the respective banks 12 and 14, the secondary inertia couples thereof are balanced. Accordingly, in the configuration of the first exemplary embodiment, the secondary inertia couple is not generated in the crankshaft 20.

<6.5 Respective Inertial Forces and Secondary Inertia Couple in the Second Exemplary Embodiment>

In the configuration of the second exemplary embodiment, as compared with the configuration of the first exemplary embodiment, the arrangement of the crank pins 34 of cylinder numbers #2 and #3 and the arrangement of the crank pins 34 of cylinder numbers #6 and #7 are simply interchanged, and therefore, within the respective banks 12 and 14, the primary inertial forces, the secondary inertial forces, and the secondary inertia couples are balanced, in the same manner as in the configuration of the first exemplary embodiment. Accordingly, also in the configuration of the second exemplary embodiment, the primary inertial force, the secondary inertial force, and the secondary inertia couple are not generated.

<6.6 Primary Inertia Couple in the Configuration of the First Exemplary Embodiment>

In contrast thereto, the primary inertia couple may be generated in each of the configurations of the first exemplary embodiment and the second exemplary embodiment. In this instance, according to the first exemplary embodiment, in relation to the primary inertia couple on the one bank 12 side, Mxb11, which is a moment around the XB1-axis in the coordinate system of the one bank 12, is expressed by the following equation (9).

$$Mxb11 = Fy11\times L1 + Fy21\times L2 + Fy31\times L3 + Fy41\times L4 = \tag{9}$$
$$mrot\times r\times\omega^2\times\{\sin(\theta-30°)\times L1 + \sin(\theta-30°+270°)\times L2 +$$
$$\sin(\theta-30°+90°)\times L3 + \sin(\theta-30°+180°)\times L4\} =$$
$$-mrot\times r\times\omega^2\times s\times\{3\times\sin(\theta-30°) - \cos(\theta-30°)\}$$

Fy11 to Fy41 are y directional components, and more specifically, the YB1 directional components of the primary inertial forces generated in the cylinders 16 of cylinder numbers #1 to #4 in the coordinate systems of the respective banks. Further, in equation (9), a relationship between the bore pitch s and L1 to L4 is as shown in the following equation (10) and equation (11).

$$L1-L4=3\times s \tag{10}$$

$$L2=L3=s \tag{11}$$

In this instance, the above-described equation (9) is changed into the later-described equation (13) using the composite equation of a general trigonometric function of the following equation (12).

$$A\times\sin\varphi + B\times\cos\varphi = (A^2+B^2)^{1/2}\times\sin(\varphi+\alpha) \tag{12}$$

In this case, $\alpha=\tan^{-1}(B/A)$. Further, A and B are arbitrary numbers. Accordingly, when equation (12) is used, the above-described equation (9) is represented as in the following equation (13).

$$Mxb11=-mrot\times r\times\omega^2\times s\times(3^2+1^2)^{1/2}\times\sin\{\theta-30^\circ-\tan^{-1}(1/3)\}=-10^{1/2}\times mrot\times r\times\omega^2\times s\times\sin\{\theta-30^\circ-\tan^{-1}(1/3)\} \quad (13)$$

Further, in relation to the primary inertia couple on the one bank 12 side, Myb11, which is a moment around the YB1-axis in the coordinate system of the one bank 12, is expressed by the following equation (14). The bore pitch s in equation (14) is the same as that in the above-described equation (10) and equation (11).

$$\begin{aligned} Myb11 &= Fx11\times L1+Fx21\times L2+Fx31\times L3+Fx41\times L4= \quad (14)\\ &(mrec+mrot)\times r\times\omega^2\times\{\cos(\theta-30^\circ)\times L1+\cos(\theta-30^\circ+270^\circ)\times L2+\\ &\cos(\theta-30^\circ+90^\circ)\times L3+\cos(\theta-30^\circ+180^\circ)\times L4\}=\\ &(mrec+mrot)\times r\times\omega^2\times s\times\{\sin(\theta-30^\circ)+3\times\cos(\theta-30^\circ)\}\end{aligned}$$

In this instance, when $\beta=\tan^{-1}(A/B)$ and the composite equation of the general trigonometric function of the following equation (15) is used, the above-described equation (14) is expressed by the following equation (16).

$$A\times\sin\varphi+B\times\cos\varphi=\left(A^2+B^2\right)^{1/2}\times\cos(\varphi-\beta) \quad (15)$$

$$\begin{aligned} Myb11 &= \quad (16)\\ &(mrec+mrot)\times r\times\omega^2\times s\times\left(1^2+3^2\right)^{1/2}\times\cos\left\{\theta-30^\circ-\tan^{-1}(1/3)\right\}=\\ &10^{1/2}\times(mrec+mrot)\times r\times\omega^2\times s\times\cos\left\{\theta-30^\circ-\tan^{-1}(1/3)\right\}\end{aligned}$$

In contrast thereto, in relation to the primary inertia couple on the other bank 14 side, Mxb21, which is a moment around the XB2-axis in the coordinate system of the other bank 14 (the XB2-YB2-Z coordinate system), is expressed by the following equation (17) similarly to the above-described moment Mxb11.

$$\begin{aligned} Mxb21 &= Fy51\times L5+Fy61\times L6+Fy71\times L7+Fy81\times L8= \quad (17)\\ &-mrot\times r\times\omega^2\times s\times(\sin\theta+3\times\cos\theta)\end{aligned}$$

In this instance, as shown in FIGS. 3 and 4, L5 to L8 are Z coordinate values of points where the connecting rods 30 corresponding to the cylinders 16 of cylinder numbers #5 to #8 are projected onto the Z-axis. Further, Fy51 to Fy81 are y directional components, and more specifically, the YB2 directional components of the primary inertial forces generated in the cylinders 16 of cylinder numbers #5 to #8 in the coordinate systems of the respective banks. Further, in equation (17), a relationship between L5 to L8 and the bore pitch s is as shown in the following equation (18) and equation (19).

$$L5-L8=3\times s \quad (18)$$

$$L6-L7=s \quad (19)$$

In addition, when equation (15) is used, the above-described equation (17) is expressed by the following equation (20).

$$Mxb21=-10^{1/2}\times mrot\times r\times\omega^2\times s\times\cos\{\theta-\tan^{-1}(1/3)\} \quad (20)$$

Further, in relation to the primary inertia couple on the other bank 14 side, Myb21, which is a moment around the YB2-axis in the coordinate system of the other bank 14, is expressed by the following equation (21) similarly to the above-described moment Myb11.

$$\begin{aligned} Myb21 &= Fx51\times L5+Fx61\times L6+Fx71\times L7+Fx81\times L8= \quad (21)\\ &-(mrec+mrot)\times r\times\omega^2\times s\times(3\times\sin\theta-\cos\theta)\end{aligned}$$

Moreover, Fx51 to Fx81 are XB2 directional components of the primary inertial force generated in the cylinders 16 of cylinder numbers #5 to #8. In addition, when equation (12) is used, the above-described equation (21) is represented as in the following equation (22).

$$Myb21=-10^{1/2}\times(mrec+mrot)\times r\times\omega^2\times s\times\sin\{\theta-\tan^{-1}(1/3)\} \quad (22)$$

The above-described equations (13), (16), (20), and (22) are expressed respectively in the XB1-YB1-Z coordinate system and the XB2-YB2-Z coordinate system shown in FIGS. 10 and 11. If these equations are converted into an X-Y-Z coordinate system, the moment Mx11 around the X-axis of the primary inertia couple on the one bank 12 side, and the moment Mx21 around the X-axis of the primary inertia couple on the other bank 14 side can be determined. In this instance, general coordinate conversion formulas are expressed by the following equations (23) to (25).

$$X=x\times\cos\varphi-y\times\sin\varphi \quad (23)$$

$$Y=x\times\sin\varphi+y\times\cos\varphi \quad (24)$$

$$\begin{pmatrix}X\\Y\end{pmatrix}=\begin{pmatrix}\cos\phi & -\sin\phi\\ \sin\phi & \cos\phi\end{pmatrix}\begin{pmatrix}x\\y\end{pmatrix} \quad (25)$$

In this instance, equations (23) to (25) are equations for determining the coordinates (X, Y) of an arbitrary point (x, y) rotated by an angle of φ around the origin in a two-dimensional Cartesian coordinate system. Accordingly, by using equations (23) to (25), the moment of the primary inertia couple, which is made up from each of the XB1-YB1 coordinate system and the XB2-YB2 coordinate system, can be converted into a moment in the XY coordinate system. In this instance, when explaining the one bank 12 side as an example, the XB1-YB1 coordinate system can be converted to the XY coordinate system by being rotated clockwise by 30° about the origin. Accordingly, as described below, the equations for the moments can be derived from equations (23) and (24).

More specifically, based on equation (13) and equation (16) and the fact that the angle φ is 30° in equation (23) in relation to the cylinder 16 of cylinder number #1, the moment Mx11 around the X-axis of the primary inertia couple on the one bank 12 side is expressed by the following equation (26).

$$\begin{aligned} Mx11 &= Mxb11\times\cos(30^\circ)-Myb11\times\sin(30)= \quad (26)\\ &10^{1/2}\times r\times\omega^2\times s\times\left[-mrot\times\sin\left\{\theta-30^\circ-\tan^{-1}(1/3)\right\}\times\cos(30^\circ)-\right.\\ &\left.(mrec+mrot)\times\cos\left\{\theta-30^\circ-\tan^{-1}(1/3)\right\}\times\sin(30^\circ)\right]=\end{aligned}$$

-continued $$10^{1/2}\times r\times\omega^2\times s\times\left[-mrot\times\left\{\sin\left\{\theta-30^\circ-\tan^{-1}(1/3)\right\}\times\cos(30^\circ)+\cos\left\{\theta-30^\circ-\tan^{-1}(1/3)\right\}\times\sin(30^\circ)\right\}-mrec\times\cos\left\{\theta-30^\circ-\tan^{-1}(1/3)\right\}\times(1/2)\right]$$

In this instance, using an equation of the addition theorem of a general trigonometric function of the following equation (27), the above-described equation (26) is changed to the later-described equation (28).

$$\sin\alpha\times\cos\beta+\cos\alpha\times\sin\beta=\sin(\alpha+\beta) \tag{27}$$

$$Mx11=10^{1/2}\times r\times\omega^2\times s\times\left[-mrot\times\sin\left\{\theta-30^\circ-\tan^{-1}(1/3)+30^\circ\right\}-(1/2)\times mrec\times\cos\left\{\theta-30^\circ-\tan^{-1}(1/3)\right\}\right]=10^{1/2}\times r\times\omega^2\times s\times\left[-(1/2)\times mrec\times\cos\left\{\theta-30^\circ-\tan^{-1}(1/3)\right\}-mrot\times\sin\left\{\theta-\tan^{-1}(1/3)\right\}\right] \tag{28}$$

Further, similarly to the above-described moment Mx11, the moment Mx21 around the X-axis of the primary inertia couple on the other bank 14 side is also expressed by the following equation (29).

$$Mx21=10^{1/2}\times r\times\omega^2\times s\times[(-1/2)\times mrec\times\sin\{\theta-\tan^{-1}(1/3)\}-mrot\times\cos\{\theta-\tan^{-1}(1/3)-30^\circ\}] \tag{29}$$

Furthermore, also concerning the moment My11, which is the moment around the Y-axis of the primary inertia couple on the one bank 12 side, and the moment My21, which is the moment around the Y-axis of the primary inertia couple on the other bank 14 side, these moments are expressed by the following equations (30) and (31), similarly to the above described moments Mx11 and Mx21.

$$My11=10^{1/2}\times r\times\omega^2\times s\times[(mrec+mrot)\times\cos\{\theta-\tan^{-1}(1/3)\}+(1/2)\times mrec\times\sin\{\theta-30^\circ-\tan^{-1}(1/3)\}] \tag{30}$$

$$My21=10^{1/2}\times r\times\omega^2\times s\times[-(mrec+mrot)\times\sin\{\theta-30^\circ-\tan^{-1}(1/3)\}-(1/2)\times mrec\times\cos\{\theta-\tan^{-1}(1/3)\}] \tag{31}$$

In addition, using equation (28) of Mx11 and equation (29) of Mx21, and A×C+A×D+B×C+B×D=(A+B)×(C+D), which is a general factorization formula, the moment Mx around the X-axis of the primary inertia couple that acts on the crankshaft 20 as a whole is expressed by the following equation (32).

$$Mx=Mx11+Mx21=10^{1/2}\times r\times\omega^2\times s\times\left[(-1/2)\times mrec\times\cos\left\{\theta-30^\circ-\tan^{-1}(1/3)\right\}-mrot\times\sin\left\{\theta-\tan^{-1}(1/3)\right\}\right]+10^{1/2}\times r\times\omega^2\times s\times\left[(-1/2)\times mrec\times\sin\left\{\theta-\tan^{-1}(1/3)\right\}-mrot\times\cos\left\{\theta-\tan^{-1}(1/3)-30^\circ\right\}\right]=10^{1/2}\times r\times\omega^2\times s\times\left\{(-1/2)\times mrec-mrot\times\left[\cos\left\{\theta-30^\circ-\tan^{-1}(1/3)\right\}+\sin\left\{\theta-\tan^{-1}(1/3)\right\}\right]\right. \tag{32}$$

In this instance, using an equation of the addition theorem of a general trigonometric function of the following equation (33), the above-described equation (32) is changed.

$$\cos(\alpha-\beta)=\cos\alpha\times\cos\beta+\sin\alpha\times\sin\beta \tag{33}$$

It should be noted that, in equation (33), α and β are arbitrary angles. Accordingly, when equation (33) is used, the term $\cos\{\theta-30^\circ-\tan^{-1}(1/3)\}$ in equation (32) is expressed as in the following equation (34).

$$\cos\left\{\theta-30^\circ-\tan^{-1}(1/3)\right\}=\cos\left\{\theta-\tan^{-1}(1/3)\right\}\times\cos(30^\circ)+\sin\left\{\theta-\tan^{-1}(1/3)\right\}\times\sin(30^\circ)=\cos\left\{\theta-\tan^{-1}(1/3)\right\}\times(3^{1/2}/2)+\sin\left\{\theta-\tan^{-1}(1/3)\right\}\times(1/2)=(3^{1/2}/2)\times\cos\left\{\theta-\tan^{-1}(1/3)\right\}+(1/2)\times\sin\left\{\theta-\tan^{-1}(1/3)\right\} \tag{34}$$

When equation (34) is substituted into equation (32), Mx is expressed as in the following equation (35).

$$Mx=10^{1/2}\times r\times\omega^2\times s\times\{(-1/2)\times mrec-mrot\}\times[(3^{1/2}/2)\times\cos\{\theta-\tan^{-1}(1/3)\}+(3/2)\times\sin\{\theta-\tan^{-1}(1/3)\}] \tag{35}$$

In this instance, when equation (12) is used, Mx is expressed as in the following equation (36). In equation (36), in order to organize the equation, the numerical portions thereof are combined into one, the coefficients of mrec and mrot are converted into integers, 180° is added to the sin portion to invert the phase thereof, and the negative sign of the entire equation is eliminated.

$$Mx=10^{1/2}\times r\times\omega^2\times s\times\left\{(3/2)^2+(3^{1/2}/2)^2\right\}^{1/2}\times(1/2)\times2\times\left\{(-1/2)\times mrec-mrot\right\}\times\sin\left[\theta-\tan^{-1}(1/3)+30^\circ\right]=-(30^{1/2}/2)\times r\times\omega^2\times s\times(mrec+2\times mrot)\times\sin\left[\theta-\tan^{-1}(1/3)+30^\circ\right]=(30^{1/2}/2)\times r\times\omega^2\times s\times(mrec+2\times mrot)\times\sin\left[\theta+210^\circ-\tan^{-1}(1/3)\right] \tag{36}$$

On the other hand, the moment My around the Y-axis of the primary inertia couple that acts on the crankshaft 20 as a whole is expressed by the following equation (37) when the coordinates thereof are converted using equations (30) and (31), in the same manner as for the moment Mx.

$$My=My11+My12=10^{1/2}\times r\times\omega^2\times s\times\left\{(-1/2)\times mrec-mrot\right\}\times\left[\sin\left\{\theta-30^\circ-\tan^{-1}(1/3)\right\}\cos\left\{\theta-\tan^{-1}(1/3)\right\}\right]=(30^{1/2}/2)\times r\times\omega^2\times s\times(mrec+2\times mrot)\times\sin\left\{\theta+120^\circ-\tan^{-1}(1/3)\right\} \tag{37}$$

From the above, if mrot=(−½)×mrec is established in each of the cylinders 16, the primary inertia couple is capable of being canceled out. Further, in the case of mrot≠(−½)×mrec, the primary inertia couple is capable of being canceled out, as will be described later.

Figure 16A:
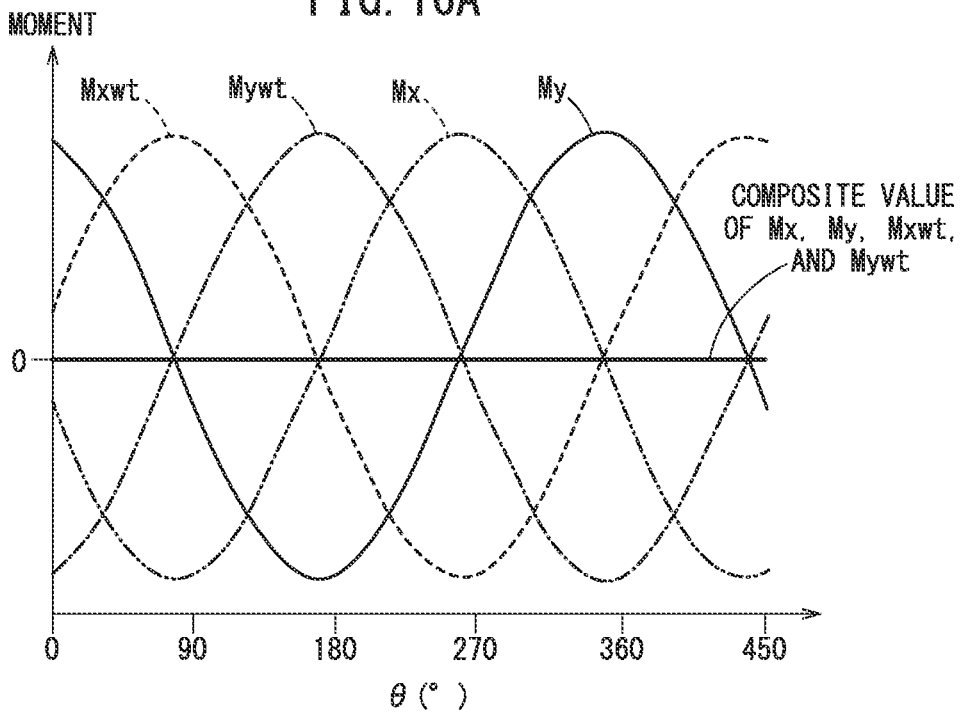
FIG. 16A is an explanatory diagram of a primary inertia couple of the first exemplary embodiment.

In this instance, the sign of θ is positive, and Mx and My have the same amplitude and are delayed by 90° in phase as shown in FIG. 16A. Therefore, the primary inertia couple acts as a precession in the same direction as the direction of rotation of the engine 10. Accordingly, as shown in FIGS. 2 to 8, the primary inertia couple can be canceled out by adding the weights 40 which serve as balancing weights.

In this case, the weight 40 is disposed on the other end portion 20*b* side at an angular position of θwt in FIGS. 2 and 10. Further, the weight 40 is also disposed on the one end portion 20*a* side at an angular position that is 180° out of phase with the weight 40 on the other end portion 20*b* side, with the main rotating shafts 36 being interposed therebetween. More specifically, two weights 40 are disposed.

Further, as shown in the equations (36) and (37), the moments of inertia of the weights 40 are expressed by $(30^{1/2}/2)\times r\times s\times(mrec+2\times mrot)$. In FIG. 16A, a case is illustrated in which Mx and My, which are the primary inertia couples generated in the crankshaft 20, are canceled out due to the couples by the added weights 40 (a moment Mxwt around the X-axis due to the weights 40, and a moment Mywt around the Y-axis due to the weights 40).

In this instance, the moment Mxwt around the X-axis due to the weights 40 can be expressed by the following equation (38). In this case, the phase of the moment Mxwt is shifted in phase by 180° from the phase of the sin portion of equation (36).

$$Mxwt=(30^{1/2}/2)\times r\times\omega^2\times s\times(\text{mrec}+2\times\text{mrot})\times\sin\{\theta+30°-\tan^{-1}(1/3)\} \quad (38)$$

Further, the moment Mywt around the Y-axis due to the weights 40 can be expressed by the following equation (39). In this case, the phase of the moment Mywt is shifted in phase by 180° from the phase of the sin portion of equation (37).

$$Mywt=(30^{1/2}/2)\times r\times\omega^2\times s\times(\text{mrec}+2\times\text{mrot})\times\sin\{\theta+300°-\tan^{-1}(1/3)\} \quad (39)$$

To explain in greater detail, as shown in FIGS. 2 and 10, on the other end portion 20*b* side, the weight 40 is disposed at an angular position of θwt, and on the one end portion 20*a* side as well, the weight 40 is disposed at an angular position on an opposite side from the weight 40 on the other end portion 20*b* side, with the main rotating shafts 36 being interposed therebetween. Due to the two weights 40, the moments Mxwt and Mywt are generated that are 180° out of phase with respect to the phases shown in equation (36) and equation (37). Consequently, the primary inertia couple is capable of being canceled out.

In this instance, θwt, which is the phase of the weight 40 on the other end portion 20*b* side, is an angle from the crank pin 34 of cylinder number #1, and is expressed by the following equation (40) since $\tan^{-1}(1/3)\approx 18.43°$.

$$\theta wt = 210° - \tan^{-1}(1/3) - 180° = 30° - \tan^{-1}(1/3) \approx 11.57° \quad (40)$$

Accordingly, on the other end portion 20*b* side, it is preferable to provide the weight 40 at a phase of 11.57° from the angular position of the crank pin 34 of cylinder number #1.

Further, the weight 40 to be disposed on the one end portion 20*a* side may be provided at a position which is rotated by 180° with respect to the weight 40 on the other end portion 20*b* side. In this instance, an angular position θwa of the weight 40 disposed on the one end portion 20*a* side is expressed by the following equation (41).

$$\theta wa = \theta wt + 180° = 11.57° + 180° = 191.57° \quad (41)$$

Further, as shown in equation (38) and equation (39), the moment of inertia of the weight 40 becomes $(30^{1/2}/2)\times r\times s\times(\text{mrec}+2\times\text{mrot})$. In FIG. 16A, a case is illustrated in which Mx and My, which are the primary inertia couples generated in the crankshaft 20, are canceled out due to the couples by the added weights 40 (the moments Mxwt and Mywt).

<6.7 Primary Inertia Couple in the Configuration of the Second Exemplary Embodiment>

In the configuration of the second exemplary embodiment as well, when the same calculations as those of the equations for the primary inertia couples in the first exemplary embodiment are carried out, it is understood that the primary inertia couples generated in the crankshaft 20 can be determined by shifting the phase by $2\times\tan^{-1}(1/3)$ with respect to the primary inertia couples of equation (36) and equation (37). More specifically, similar to the first exemplary embodiment, by performing a coordinate conversion, the components of the two banks 12 and 14 can be expressed by the following equations (42) and (43).

$$Mx=(30^{1/2}/2)\times r\times\omega^2\times s\times(\text{mrec}+2\times\text{mrot})\times\sin\{\theta+210°+\tan^{-1}(1/3)\} \quad (42)$$

$$My=(30^{1/2}/2)\times r\times\omega^2\times s\times(\text{mrec}+2\times\text{mrot})\times\sin\{\theta+120°+\tan^{-1}(1/3)\} \quad (43)$$

In the configuration of the second exemplary embodiment as well, similar to the configuration of the first exemplary embodiment, the primary inertia couple acts as a forward precession. Therefore, by adding the weights 40, it becomes possible for the primary inertia couple to be canceled out.

Since the configuration is the same as that of the first exemplary embodiment, the details thereof are omitted herein, and only the results will be described. In the second exemplary embodiment as well, the weight 40 is disposed at an angular position of θwt from the crank pin 34 of cylinder number #1 shown in FIGS. 6 and 11. In this instance, θwt is expressed by the following equation (44).

$$\theta wt = 210° + \tan^{-1}(1/3) - 180° = 30° + \tan^{-1}(1/3) \approx 48.43° \quad (44)$$

Thus, it is preferable to provide the weight 40 on the other end portion 20*b* side, at a phase of 48.43° from the angular position of the crank pin 34 of cylinder number #1 shown in FIGS. 6 and 11. Further, the weight 40 to be disposed on the one end portion 20*a* side may be provided at an angular position which is rotated by 180° with respect to the weight 40 on the other end portion 20*b* side. In this instance, the angular position θwa of the weight 40 disposed on the one end portion 20*a* is expressed by the following equation (45).

$$\theta wa=48.43°+180°=228.43° \quad (45)$$

Figure 16B:
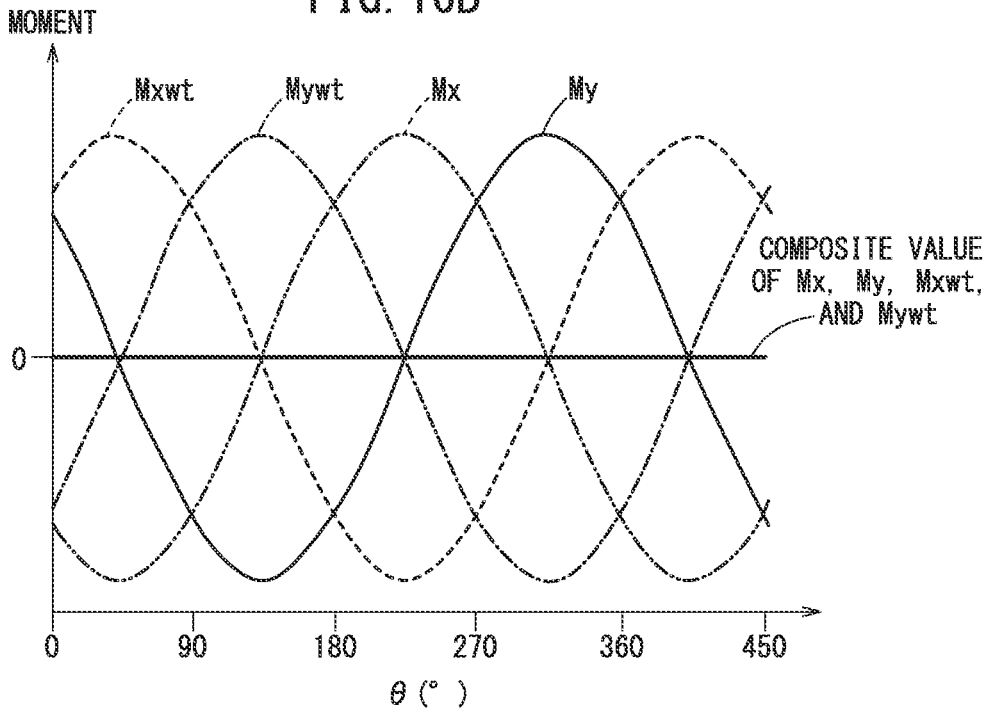
FIG. 16B is an explanatory diagram of a primary inertia couple of the second exemplary embodiment.

Further, as shown in equation (42) and equation (43), the moment of inertia of the weight 40 becomes $(30^{1/2}/2)\times r\times s\times(\text{mrec}+2\times\text{mrot})$. In FIG. 16B, a case is illustrated in which Mx and My, which are the primary inertia couples generated in the crankshaft 20, are canceled out due to the couples Mxwt and Mywt by the added weights 40.

<6.8 Relationship between Offset of the Crank Pins 34 and the Primary Inertia Couple>

Figure 17:
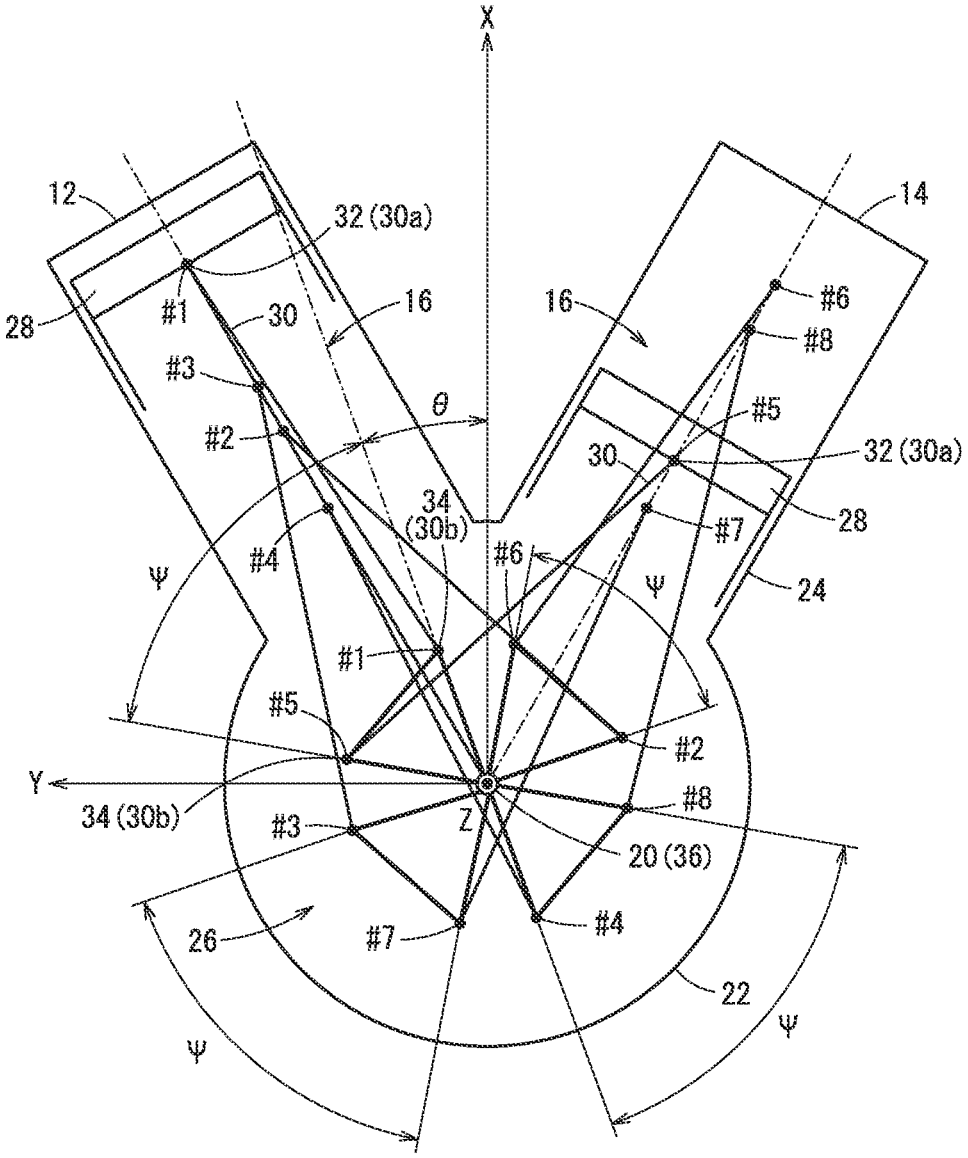
FIG. 17 is a schematic plan view illustrating an offset angle of the crank pins.
Figure 18:
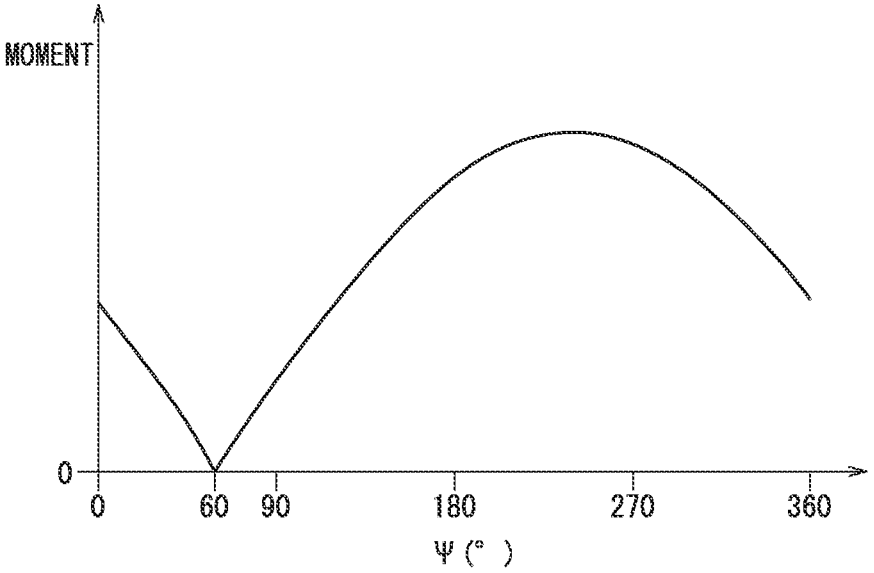
FIG. 18 is an explanatory diagram showing a relationship between the offset angle and a primary inertia couple.

Next, concerning the engine 10 according to the present embodiment, the relationship between the offset of the crank pins 34 and the primary inertia couple will be described. As shown in FIG. 17, the angle formed by the X-axis and the crank pin 34 of cylinder number #1 is defined as θ, and the offset angle of the crank pins 34 on the other bank 14 side with respect to the crank pins 34 on the one bank 12 side is defined as ψ. In the present embodiment, by adopting the above-described configurations of the first exemplary embodiment and the second exemplary embodiment, an amplitude Mmag of the primary inertia couple can be set to 0 at an offset angle of ψ=60° as shown in FIG. 18. Since the primary inertial force, the secondary inertial force, and the secondary inertia couple are 0 in the respective banks, they always remain 0 even if the offset angle ψ is changed.

More specifically, in the first exemplary embodiment, using the relational expression of $\text{mrot}=(-1/2)\times\text{mrec}$, the primary inertia couples Mx and My can be rewritten in the form of the following equation (46) and equation (47) from the aforementioned equation (36) and equation (37).

$$Mx=(10^{1/2}/2)\times r\times\omega^2\times s\times\text{mrec}\times\{2-2\times\cos(\psi-60°)\}^{1/2}\times\sin[\theta-\tan^{-1}(1/3)-\tan^{-1}\{\sin(\psi-60°)/(1-\cos(\psi-60°))\}-60°] \quad (46)$$

$$My=(10^{1/2}/2)\times r\times\omega^2\times s\times\text{mrec}\times\{2-2\times\cos(\psi-60°)\}^{1/2}\times\sin[\theta-\tan^{-1}(1/3)-\tan^{-1}\{\sin(\psi-60°)/(1-\cos(\psi-60°))\}+30°] \quad (47)$$

Consequently, the amplitude Mmag of the primary inertia couple can be expressed by the following equation (48).

$$Mmag=(10^{1/2}/2)\times r\times\omega^2\times s\times \text{mrec}\times \{2-2\times\cos(\psi-60°)\}^{1/2} \quad (48)$$

In order to set the amplitude expressed by equation (48) to 0, it can be understood that the offset angle ψ should be set to 60°. Moreover, concerning the second exemplary embodiment as well, the same results can be obtained.

[7. Effects of the Present Embodiment]

As has been described previously, in the engine 10 (V8 engine) according to the present embodiment, the bank angle between the two banks 12 and 14 is 60°, and the engine includes the crankshaft 20, the eight pistons (28) disposed in the respective cylinders 16 of each of the banks 12 and 14, and the eight connecting rods 30 having the small end portions 30*a* engaged with the piston pins 32 provided on the respective pistons 28, and having the large end portions 30*b* engaged with the crank pins 34 provided on the crankshaft 20.

In this case, for each of the banks 12 and 14, four crank pins 34, which are connected via the connecting rods 30 to four piston pins 32, are disposed at an interval of 90° as viewed from the Z direction (as viewed from the one end portion 20*a* of the crankshaft 20). Further, along the Z direction from the one end portion 20*a* to the other end portion 20*b*, the four crank pins 34 on the other bank 14 side, which are formed in pairs with the four crank pins 34 on the one bank 12 side, are offset therefrom by 60° when viewed from the Z direction.

In this manner, for each of the banks 12 and 14, the four crank pins 34 are disposed at an interval of 90°, and the four crank pins 34 on the other bank 14 side are offset by 60° with respect to the four crank pins 34 on the one bank 12 side, and therefore, without the addition of specialized component parts, it becomes possible for the primary inertia couple to be canceled out.

In this instance, in the configuration of the first exemplary embodiment, the four crank pins 34 on the one bank 12 side are provided on the crankshaft 20 at a predetermined interval from the one end portion 20*a* to the other end portion 20*b* of the crankshaft 20. Further, the four crank pins 34 on the other bank 14 side are provided on the crankshaft 20 at a predetermined interval from the one end portion 20*a* to the other end portion 20*b* of the crankshaft 20, so as to be arranged between the four crank pins 34 on the one bank 12 side.

In this case, for each of the banks 12 and 14, when viewed from the one end portion 20*a* to the other end portion 20*b*, among the four crank pins 34, the crank pin 34 on the one end portion 20*a* side and the crank pin 34 on the other end portion 20*b* side are arranged point-symmetrically with the crankshaft 20 being interposed therebetween. Further, among the two crank pins 34 between the crank pin 34 on the one end portion 20*a* side and the crank pin 34 on the other end portion 20*b* side, the crank pin 34 in proximity to the one end portion 20*a* is arranged so as to be offset by 270° with respect to the crank pin 34 on the one end portion 20*a* side. Furthermore, the crank pin 34 in proximity to the other end portion 20*b* is arranged so as to be offset by 90° with respect to the crank pin 34 on the one end portion 20*a* side.

In addition, the four crank pins 34 on the other bank 14 side are offset by 60° with respect to the four crank pins 34 on the one bank 12 side.

In accordance with such a configuration, the primary inertia couple can be easily canceled out with a simple configuration.

Further, the configuration of the second exemplary embodiment differs from the configuration of the first exemplary embodiment in that, when viewed from the Z direction, among the two crank pins 34 between the crank pin 34 on the one end portion 20*a* side and the crank pin 34 on the other end portion 20*b* side, the crank pin 34 in proximity to the other end portion 20*b* is arranged so as to be offset by 270° with respect to the crank pin 34 on the one end portion 20*a* side, and the crank pin 34 in proximity to the one end portion 20*a* is arranged so as to be offset by 90° with respect to the crank pin 34 on the one end portion 20*a* side. In accordance with this configuration as well, the primary inertia couple can be easily canceled out.

Further, in the engine 10, an ignition timing of the respective cylinders 16 involves explosions at non-regular intervals in a combination of a 60° interval, a 90° interval, and a 120° interval. However, in each of the banks 12 and 14, the ignition timing of the four cylinders 16 involves explosions at non-regular intervals in a combination of a 90° interval, a 180° interval, and a 270° interval. In other words, in each of the banks 12 and 14, the ignition timing is the same as that of the conventional V8 engine. Consequently, it becomes possible to secure the same output as the conventional V8 engine.

Further, in the main motion system 26 including the crankshaft 20, the pistons 28, and the connecting rods 30, in the case that a rotating member mass mrot, which is a mass on the crank pin 34 side, is −½ of a reciprocating member mass mrec, which is a mass on the piston pin 32 side (mrot=(−½)×mrec), the addition of the weights 40 to the crankshaft 20 is unnecessary. On the other hand, in the case that the rotating member mass mrot is not −½ of the reciprocating member mass mrec (mrot≠(−½)×mrec), the weights 40, which balance the primary inertia couple generated in the crankshaft 20 at a time when the engine 10 is rotating, may be added to the crankshaft 20.

In accordance with such features, a balancer or the like that rotates in a direction opposite to the direction of rotation of the engine 10 is rendered unnecessary, and the primary inertia couple can be canceled out. As a result, the weight of the engine 10 can be reduced, costs can be reduced, and space savings can be achieved.

Further, a plurality of the weights 40 can be added in a distributed manner to locations corresponding to the respective cylinders 16 on the crankshaft 20. Consequently, if the moments created by the weights 40 are set so as to be balanced with the primary inertia couple in the crankshaft 20 as a whole, the primary inertia couple can be canceled out.

In accordance with the foregoing, since various vibrations can be reduced, the engine 10 according to the present embodiment can be suitably adopted as an engine for use with an outboard motor.

It should be noted that the present invention is not limited to the embodiments described above, and it goes without saying that various configurations could be adopted therein based on the content described in the present specification.

The invention claimed is:

1. A V8 engine in which a bank angle between two banks is 60°, the V8 engine comprising:

a crankshaft;

eight pistons disposed in respective cylinders of the banks; and eight connecting rods having small end portions engaged with piston pins provided on the respective pistons, and having large end portions engaged with crank pins provided on the crankshaft, wherein for each of the banks, among four of the crank pins, which are connected via the connecting rods to four of the piston pins, a crank pin on a side of one end portion of the crankshaft and a crank pin on a side of another end portion of the crankshaft are arranged point-symmetrically with the crankshaft interposed therebetween, when viewed from the one end portion, among two of the crank pins between the crank pin on the side of the one end portion and the crank pin on the side of the other end portion, the crank pin in proximity to the one end portion is arranged so as to be offset by 270° with respect to the crank pin on the side of the one end portion, and the crank pin in proximity to the other end portion is arranged so as to be offset by 90° with respect to the crank pin on the side of the one end portion, with respect to the crank pin on the side of the one end portion of one of the banks, the crank pin on the side of the one end portion of another of the banks is offset by 60°, when viewed from the one end portion, with respect to the crank pin on the side of the other end portion of the one of the banks, the crank pin on the side of the other end portion of the other of the banks is offset by 60°, when viewed from the one end portion, with respect to the crank pin in proximity to the one end portion of the one of the banks, the crank pin in proximity to the one end portion of the other of the banks is arranged so as to be offset by 60°, when viewed from the one end portion, and with respect to the crank pin in proximity to the other end portion of the one of the banks, the crank pin in proximity to the other end portion of the other of the banks is arranged so as to be offset by 60°, when viewed from the one end portion.

2. A V8 engine in which a bank angle between two banks is 60°, the V8 engine comprising:

a crankshaft;

eight pistons disposed in respective cylinders of the banks; and eight connecting rods having small end portions engaged with piston pins provided on the respective pistons, and having large end portions engaged with crank pins provided on the crankshaft, wherein for each of the banks, among four of the crank pins, which are connected via the connecting rods to four of the piston pins, a crank pin on a side of one end portion of the crank shaft and a crank pin on a side of another end portion of the crankshaft are arranged point-symmetrically with the crankshaft interposed therebetween, when viewed from the one end portion, among two of the crank pins between the crank pin on the side of the one end portion and the crank pin on the side of the other end portion, the crank pin in proximity to the other end portion is arranged so as to be offset by 270° with respect to the crank pin on the side of the one end portion, and the crank pin in proximity to the one end portion is arranged so as to be offset by 90° with respect to the crank pin on the side of the one end portion, and with respect to the crank pins on the side of the one end portion of one of the banks, the crank pin on the side of the one end portion of another of the banks is offset by 60°, when viewed from the one end portion, with respect to the crank pin on the side of the other end portion of the one of the banks, the crank pin on the side of the other end portion of the other of the banks is offset by 60°, when viewed from the one end portion, with respect to the crank pin in proximity to the one end portion of the one of the banks, the crank pin in proximity to the one end portion of the other of the banks is arranged so as to be offset by 60°, when viewed from the one end portion, and with respect to the crank pin in proximity to the other end portion of the one of the banks, the crank pin in proximity to the other end portion of the other of the banks is arranged so as to be offset by 60°, when viewed from the one end portion.

3. The V8 engine according to claim 1, wherein an ignition timing of the respective cylinders involves explosions at non-regular intervals in a combination of a 60° interval, a 90° interval, and a 120° interval.

4. The V8 engine according to claim 3, wherein for each of the banks, an ignition timing of four of the cylinders involves explosions at non-regular intervals in a combination of a 90° interval, a 180° interval, and a 270° interval.

5. The V8 engine according to claim 1, wherein in a main motion system including the crankshaft, the pistons, and the connecting rods, in a case that a rotating member mass, which is a mass on a side of the crank pins, is −½ of a reciprocating member mass, which is a mass on a side of the piston pins, an addition of a weight to the crankshaft is unnecessary, whereas, in a case that the rotating member mass is not −½ of the reciprocating member mass, a weight that balances a primary inertia couple generated in the crankshaft at a time when the V8 engine is rotating is added to the crankshaft.

6. The V8 engine according to claim 5, wherein a plurality of the weights are distributed amongst a plurality of locations corresponding to the respective cylinders on the crankshaft.

7. The V8 engine according to claim 1, wherein the V8 engine is an engine for use with an outboard motor.

* * * * *